US011371230B2

(12) United States Patent
Hayashi et al.

(10) Patent No.: US 11,371,230 B2
(45) Date of Patent: Jun. 28, 2022

(54) FLUSH WATER TANK APPARATUS AND FLUSH TOILET APPARATUS PROVIDED WITH THE SAME

(71) Applicant: TOTO LTD., Kitakyushu (JP)

(72) Inventors: Nobuhiro Hayashi, Kitakyushu (JP); Hidekazu Kitaura, Kitakyushu (JP); Akihiro Shimuta, Kitakyushu (JP); Masahiro Kuroishi, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 0 days.

(21) Appl. No.: 17/212,661

(22) Filed: Mar. 25, 2021

(65) Prior Publication Data

US 2021/0270026 A1 Sep. 2, 2021

Related U.S. Application Data

(63) Continuation of application No. PCT/JP2021/003940, filed on Feb. 3, 2021.

(30) Foreign Application Priority Data

Feb. 28, 2020 (JP) ..... JP2020-033604
Feb. 28, 2020 (JP) ..... JP2020-033607

(51) Int. Cl.
*E03D 5/02* (2006.01)

(52) U.S. Cl.
CPC ..... *E03D 5/024* (2013.01)

(58) Field of Classification Search
CPC ..... E03D 5/024; E03D 5/022; E03D 5/02; E03D 5/10

(Continued)

(56) References Cited

U.S. PATENT DOCUMENTS 2,587,901 A * 3/1952 Robinson ..... E03D 1/302 4/398
4,651,359 A * 3/1987 Battle ..... E03D 1/144 4/324

(Continued)

FOREIGN PATENT DOCUMENTS

JP 2009-257061 A 11/2009

OTHER PUBLICATIONS

International Search Report issued in PCT/JP2021/003940; dated Apr. 13, 2021.

(Continued)

*Primary Examiner* — Huyen D Le
(74) *Attorney, Agent, or Firm* — Studebaker & Brackett PC

(57) ABSTRACT

The present invention is a flush water tank apparatus (4) and includes: a storage tank (10) on which a drain port (10*a*) is formed, a discharge valve (12) opening/closing the drain port; a discharge valve hydraulic drive unit (14) driving the discharge valve using water supply pressure; a clutch mechanism (30) coupling the discharge valve and the discharge valve hydraulic drive unit to pull up the discharge valve; flush water amount selection device capable of selecting between a first and a second amount of flush water; a timing control mechanism controlling a timing of the drain port being blocked; and a control jet unit (20) jetting, when the second amount is selected, flush water to a water receiving surface provided on the timing control mechanism so that a timing of the drain port being blocked is earlier than a case of the first amount of flush water.

16 Claims, 10 Drawing Sheets

(58) Field of Classification Search
USPC ..... 4/394
See application file for complete search history.

(56) References Cited

U.S. PATENT DOCUMENTS 4,809,367 A * 3/1989 Scott ..... E03D 1/144
4/324
5,157,795 A * 10/1992 Pasquin ..... E03D 1/145
4/324
6,584,622 B1 * 7/2003 Nilsson ..... E03D 1/142
4/324
6,877,170 B1 * 4/2005 Quintana ..... E03D 5/10
4/406

OTHER PUBLICATIONS

Written Opinion issued in PCT/JP2021/003940; dated Apr. 13, 2021.

* cited by examiner

FLUSH WATER TANK APPARATUS AND FLUSH TOILET APPARATUS PROVIDED WITH THE SAME

BACKGROUND OF THE INVENTION

Field of the Invention

The present invention relates to a flush water tank apparatus and, in particular, to a flush water tank apparatus that supplies flush water to a flush toilet, and a flush toilet apparatus provided with the flush water tank apparatus.

Description of the Related Art

In Japanese Patent Laid-Open No. 2009-257061, a low tank apparatus is described. In this low tank apparatus, a hydraulic cylinder device having a piston and a drain unit is arranged inside a low tank provided with a discharge valve, and the piston and the discharge valve are coupled via a coupling unit. At the time of discharging flush water in the low tank, water is supplied to the hydraulic cylinder device by opening a solenoid value, and the piston is pushed up. Since the piston is connected to the discharge valve via the coupling unit, the discharge valve is pulled up by movement of the piston, the discharge valve is opened, and the flush water in the low tank is discharged. The water supplied to the hydraulic cylinder device flows out from the drain unit and flows into the low tank.

Furthermore, in the case of causing the discharge valve to be closed, supply of water to the hydraulic cylinder device is stopped by causing the solenoid valve to be closed. Thereby, the pushed-up piston descends, and, accompanying this, the solenoid valve returns to a valve closed position due to its own weight. At this time, since the water in the hydraulic cylinder device flows out from the drain unit little by little, the piston slowly descends, and the discharge valve gradually returns to the valve closed position. Further, in the low tank apparatus described in Japanese Patent Laid-Open No. 2009-257061, a time during which the discharge valve is opened is changed by adjusting a time during which the solenoid valve is open, and, thereby, washings with different amounts of flush water, such as large washing and small washing, are realized.

The low tank apparatus described in Japanese Patent Laid-Open No. 2009-257061, however, has a problem that it is difficult to accurately set the amount of flush water to be discharged. In other words, since water in the hydraulic cylinder device flows out from the drain unit little by little after the solenoid valve is closed to cause the discharge valve to be closed, in the low tank apparatus described in Japanese Patent Laid-Open No. 2009-257061, descent of the piston is gradual, and it is difficult to set the time during which the discharge valve is open short. Further, since the descent speed of the piston is dependent on the outflow rate of the water from the drain unit and sliding resistance of the piston, there is a possibility that variation occurs, and there is a possibility that change over time occurs. Therefore, it is difficult to accurately set the amount of flush water to be discharged, in the low tank apparatus described in Japanese Patent Laid-Open No. 2009-257061.

Therefore, an object of the present invention is to provide a flush water tank apparatus capable of accurately setting the amount of flush water to be discharged while opening the discharge valve using water pressure of supplied water, and a flush toilet apparatus provided with the flush water tank apparatus.

SUMMARY OF THE INVENTION

In order to solve the problem described above, the present invention is a flush water tank apparatus for supplying flush water to a flush toilet, the flush water tank apparatus including: a storage tank storing flush water to be supplied to the flush toilet, with a drain port for discharging the stored flush water to the flush toilet formed therein; a discharge valve opening/closing the drain port and performing supply/stop of the flush water to the flush toilet; a discharge valve hydraulic drive unit driving the discharge valve using water supply pressure of supplied tap water; a clutch mechanism coupling the discharge valve and the discharge valve hydraulic drive unit to pull up the discharge valve by driving force of the discharge valve hydraulic drive unit, and being disconnected at a predetermined timing to cause the discharge valve to descend; a flush water amount selection device capable of selecting between a first amount of flush water for washing the flush toilet and a second amount of flush water smaller than the first amount of flush water; a first float device including a first float moved according to a water level in the storage tank and a first engaging member capable of moving to an engaging position of engaging with the discharge valve to hold the discharge valve and a non-engaging position of not engaging with the discharge valve in conjunction with movement of the first float; a second float device including a second float moved according to the water level in the storage tank and a second engaging member capable of moving to an engaging position of engaging with the discharge valve and a non-discharging position of not engaging with the discharge valve in conjunction with movement of the second float and causing the second engaging member to move to the non-engaging position at a height different from a height at which the first float causes the first engaging member to move to the non-engaging position; and a float driving mechanism driving the first float to cause the first engaging member to move to the non-engaging position when the second amount of flush water is selected by the flush water amount selection device; wherein by the first engaging member of the first float device being moved to the non-engaging position, the discharge valve engages with the second engaging member of the second float device.

In the present invention configured as described above, flush water to be supplied to the flush toilet is stored in the storage tank with the drain port formed thereon. The discharge valve hydraulic drive unit drives the discharge valve using water supply pressure of supplied tap water, and performs supply/stop of flush water to the flush toilet. The clutch mechanism couples the discharge valve and the discharge valve hydraulic drive unit to pull up the discharge valve by driving force of the discharge valve hydraulic drive unit. Further, the clutch mechanism is disconnected at a predetermined timing, and, thereby, the discharge valve is caused to descend. As for an amount of flush water to wash the flush toilet, the first amount of flush water or the second amount of flush water smaller than the first amount of flush water is selected by the flush water amount selection device. Furthermore, the first engaging member of the first float device is moved to the engaging position or the non-engaging position. At the engaging position, the first engaging member engages with the discharge valve and holds the discharge valve. The second engaging member of the second float device is configured to hold the discharge valve at a height different from a height by the first float device. When the second amount of flush water is selected, the float driving mechanism drives the first float to cause the first engaging member to move to the non-engaging position. As a result, the discharge valve is engaged with the second engaging member of the second float device.

According to the present invention configured as described above, since the discharge valve and the discharge valve hydraulic drive unit are coupled by the clutch mechanism and disconnected at a predetermined timing, it becomes possible to cause the discharge valve to move irrespective of the operation speed of the discharge valve hydraulic drive unit and cause the discharge valve to be closed. Thereby, it becomes possible to, even if the operation speed of the discharge valve hydraulic drive unit varies at the time of causing the discharge valve to descend, control the timing of causing the discharge valve to be closed without being influenced by the variation. Further, since the float driving mechanism drives the first float to cause the first engaging member to move to the non-engaging position, it is possible to selectively cause the first float device or the second float device to operate according to a selected amount of flush water. Thereby, it is possible to set the first or second amount of flush water using the clutch mechanism.

According to the present invention, it is possible to provide a flush water tank apparatus capable of accurately setting the amount of flush water to be discharged while opening a discharge valve by a discharge valve hydraulic drive unit, and a flush toilet apparatus provided with the flush water tank apparatus.

DETAILED DESCRIPTION OF THE PREFERRED EMBODIMENTS

Next, a flush toilet apparatus according to an embodiment will be described with reference to accompanying drawings.

Figure 1:
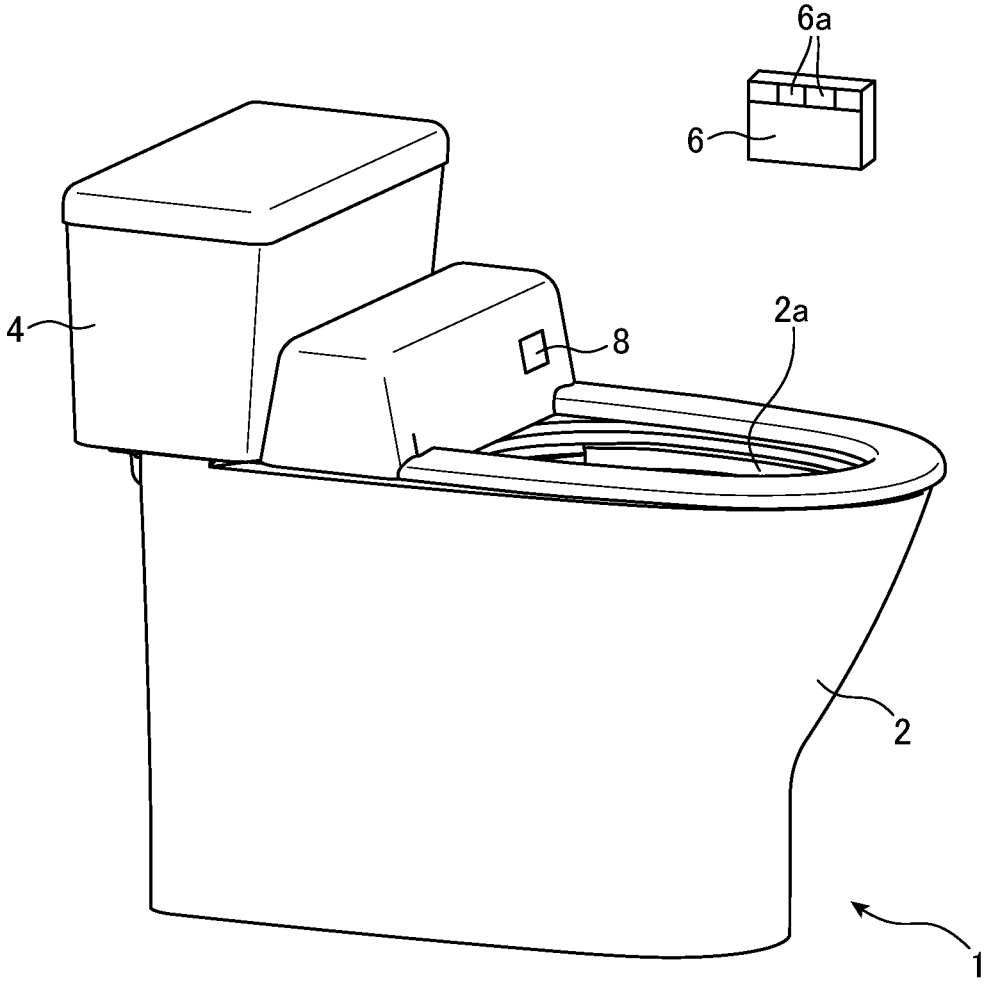
FIG. 1 is a perspective view showing an overall flush toilet apparatus provided with a flush water tank apparatus according to an embodiment of the present invention.
Figure 2:
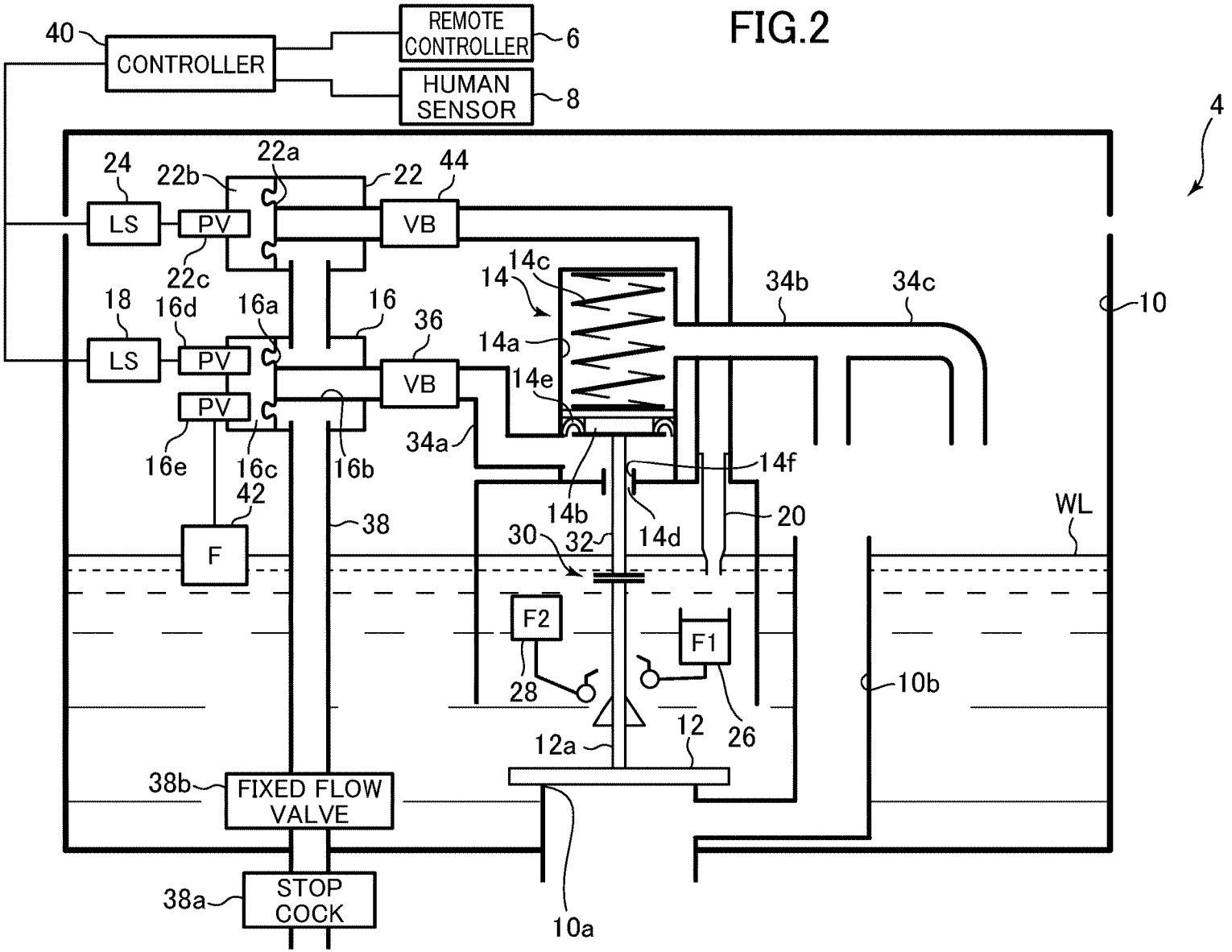
FIG. 2 is a sectional view showing a schematic configuration of the flush water tank apparatus according to the embodiment of the present invention.

FIG. 1 is a perspective view showing an overall flush toilet apparatus provided with a flush water tank apparatus according to an embodiment of the present invention. FIG. 2 is a sectional view showing a schematic configuration of the flush water tank apparatus according to the embodiment of the present invention.

As shown in FIG. 1, a flush toilet apparatus 1 according to the embodiment of the present invention is configured with a flush toilet main body 2, which is a flush toilet, and a flush water tank apparatus 4 according to the embodiment of the present invention, which is placed at the back of the flush toilet main body 2. The flush toilet apparatus 1 of the present embodiment is configured so that washing of a bowl 2*a* of the flush toilet main body 2 is performed by a remote controller 6 attached to a wall surface being operated after use or by a predetermined time having passed after a human sensor 8 provided on a toilet seat detecting a user leaving the toilet seat. The flush water tank apparatus 4 according to the present embodiment is configured to discharge flush water stored inside to the flush toilet main body 2 based on an instruction signal from the remote controller 6 or the human sensor 8 and wash the bowl 2*a* by the flush water.

Further, "large washing" or "small washing" for washing the bowl 2*a* is executed by the user pressing a push button 6*a* on the remote controller 6. Therefore, in the present embodiment, the remote controller 6 functions as flush water amount selection device capable of selecting between a first amount of flush water for washing the flush toilet main body 2 and a second amount of flush water smaller than the first amount of flush water. Note that, though the human sensor 8 is provided on the toilet seat in the present embodiment, the present invention is not limited to this form. The human sensor 8 is only required to be provided at a position where it is possible to detect the user's motions of sitting on, standing from, approach to and leaving from the toilet seat, and holding his hand. For example, the human sensor 8 may be provided on the flush toilet main body 2 or the flush water tank apparatus 4. Further, the human sensor 8 may be anything that can detect the user's motions of sitting on, standing from, approach to and leaving from the toilet seat, and holding his hand, and, for example, an infrared sensor or a microwave sensor can be used as the human sensor 8.

As shown in FIG. 2, the flush water tank apparatus 4 has a storage tank 10 for storing flush water to be supplied to the flush toilet main body 2, a discharge valve 12 for opening/closing a drain port 10*a* provided on the storage tank 10, and a discharge valve hydraulic drive unit 14 that drives the discharge valve 12. Further, the flush water tank apparatus 4 has a water supply control valve 16 that controls water supply into the discharge valve hydraulic drive unit 14 and the storage tank 10, a solenoid valve 18 attached to the water supply control valve 16 inside the storage tank 10. Furthermore, the flush water tank apparatus 4 has a control jet unit 20 that jets flush water to control the amount of flush water, a flush water amount control valve 22 for supplying flush water to the control jet unit 20, and a solenoid valve 24 attached to the flush water amount control valve 22 inside the storage tank 10. Further, the flush water tank apparatus 4 has a first float device 26 for holding the pulled-up discharge valve 12 at a first position, and a second float device 28 for holding the discharge valve 12 at a second position lower than the first position. Furthermore, the flush water tank apparatus 4 has a clutch mechanism 30, and the clutch mechanism 30 couples the discharge valve 12 and the discharge valve hydraulic drive unit 14 to pull up the discharge valve 12 by driving force of the discharge valve hydraulic drive unit 14.

The storage tank 10 is a tank configured to store flush water to be supplied to the flush toilet main body 2, and the drain port 10*a* for discharging the stored flush water to the flush toilet main body 2 is formed on a bottom portion of the storage tank 10. Inside the storage tank 10, an overflow pipe 10*b* is connected to the downstream side of the drain port 10*a*. The overflow pipe 10*b* vertically rises from near the drain port 10*a* and extends above a stopped water level WL of the flush water stored in the storage tank 10. Therefore, flush water that has flowed in from the upper end of the overflow pipe 10*b* bypasses the drain port 10*a* and flows out directly to the flush toilet main body 2.

The discharge valve 12 is a valve body arranged so as to open/close the drain port 10*a*. The discharge valve 12 is opened by being pulled upward, and flush water in the storage tank 10 is discharged to the flush toilet main body 2, so that the bowl 2*a* is washed. The discharge valve 12 is pulled up by driving force of the discharge valve hydraulic drive unit 14. When the discharge valve 12 is pulled up to a predetermined height, the clutch mechanism 30 is disconnected, and the discharge valve 12 descends due to its own weight. When the discharge valve 12 descends, the discharge valve 12 is held for a predetermined time by the first float device 26 or the second float device 28 so that a time required for the discharge valve 12 to seat on the drain port 10*a* is adjusted.

The discharge valve hydraulic drive unit 14 is configured to utilize water supply pressure of flush water supplied from a tap water pipe to drive the discharge valve 12. Specifically, the discharge valve hydraulic drive unit 14 has a cylinder 14*a* into which water supplied from the water supply control valve 16 flows, a piston 14*b* slidably arranged in the cylinder 14*a*, and a rod 32 that projects from the lower end of the cylinder 14*a* to drive the discharge valve 12.

Furthermore, a spring 14*c* is arranged inside the cylinder 14*a* and energizes the piston 14*b* downward. A packing 14*e* is attached to the piston 14*b* so that watertightness between the inner wall surface of the cylinder 14*a* and the piston 14*b* is ensured. Furthermore, the clutch mechanism 30 is provided at the lower end of the rod 32, and the rod 32 and a valve stem 12*a* of the discharge valve 12 are coupled/released by the clutch mechanism 30.

The cylinder 14*a* is a cylindrical-shaped member, which is arranged with its axis in the vertical direction and accepts the piston 14*b* inside in a slidable state. A drive unit water supply passage 34*a* is connected to a lower end portion of the cylinder 14*a* so that water flowing out of the water supply control valve 16 flows into the cylinder 14*a*. Therefore, the piston 14*b* in the cylinder 14*a* is pushed up against energizing force of the spring 14*c* by the water flowing into the cylinder 14*a*.

On an upper part of the cylinder 14*a*, an outflow hole is provided, and a drive unit discharge passage 34*b* communicates with the inside of the cylinder 14*a* via the outflow hole. Therefore, when water flows into the cylinder 14*a* from the drive unit water supply passage 34*a* connected to a lower part of the cylinder 14*a*, the piston 14*b* is pushed upward from the lower part of the cylinder 14*a* which is a first position. Then, when the piston 14*b* is pushed up to a second position above the outflow hole, the water that flowed into the cylinder 14*a* flows through the drive unit discharge passage 34*b* from the outflow hole. In other words, when the piston 14*b* is moved to the second position, the drive unit water supply passage 34*a* and the drive unit discharge passage 34*b* are caused to communicate with each other via the inside of the cylinder 14*a*. At a distal end portion of the drive unit discharge passage 34*b* extending from the cylinder 14*a*, a discharge passage branch portion 34*c* is provided. The drive unit discharge passages 34*b* branched at the discharge passage branch portion 34*c* are configured so that one of them causes water to flow out into the storage tank 10 and the other causes water to flow out into the overflow pipe 10*b*. Therefore, a part of flush water flowing out from the cylinder 14*a* is discharged to the flush toilet main body 2 through the overflow pipe 10*b*, and the remaining flush water is stored in the storage tank 10.

The rod 32 is a rod-shaped member connected to the lower surface of the piston 14*b*. The rod 32 passes through a through hole 14*f* formed in the bottom surface of the cylinder 14*a* and extends in a manner of projecting downward from inside the cylinder 14*a*. Between the rod 32 projecting downward from the cylinder 14*a* and the inner wall of the through hole 14*f* of the cylinder 14*a*, a gap 14*d* is provided, and a part of water flowing into the cylinder 14*a* flows out from the gap 14*d*. The water flowing out from the gap 14*d* flows into the storage tank 10. Note that, since the gap 14*d* is relatively narrow, and flow channel resistance is large, pressure inside the cylinder 14*a* increases due to the water flowing into the cylinder 14*a* from the drive unit water supply passage 34*a* even in the state of water flowing out from the gap 14*d*, and the piston 14*b* is pushed up, being against the energizing force of the spring 14*c*.

The water supply control valve 16 is configured to control water supply to the discharge valve hydraulic drive unit 14 based on operation of the solenoid valve 18 and control supply/stop of water to the storage tank 10. That is to say, the water supply control valve 16 is provided with a main valve body 16*a*, a main valve port 16*b* opened/closed by the main valve body 16*a*, a pressure chamber 16*c* for causing the main valve body 16*a* to move, and two pilot valves 16*d*, 16*e* for switching pressure in the pressure chamber 16*c*.

The main valve body 16*a* is configured so as to open/close the main valve port 16*b* of the water supply control valve 16. When the main valve port 16*b* is opened, tap water supplied from a water supply pipe 38 flows into the discharge valve hydraulic drive unit 14. The pressure chamber 16*c* is provided adjacent to the main valve body 16*a* in a case of the water supply control valve 16. The pressure chamber 16*c* is configured so that a part of the tap water supplied from the water supply pipe 38 flows in so that internal pressure increases. When the pressure in the pressure chamber 16*c* increases, the main valve body 16*a* is moved toward the main valve port 16*b*, and the main valve port 16*b* is closed.

The pilot valves 16*d*, 16*e* are configured to open/close pilot valve ports (not shown) provided for the pressure chamber 16*c*. When the pilot valve ports (not shown) are opened by the pilot valves 16*d*, 16*e*, water in the pressure chamber 16*c* flows out, and the internal pressure decreases. When the pressure in the pressure chamber 16*c* decreases, the main valve body 16*a* leaves from the main valve port 16*b*, and the water supply control valve 16 is opened. Since the two pilot valves 16*d* and 16*e* are provided for the pressure chamber 16*c*, the pressure in the pressure chamber 16*c* rises when both of the pilot valves 16*d* and 16*e* are opened, and the water supply control valve 16 is closed.

The pilot valve 16*d* is moved by the solenoid valve 18 attached to the pilot valve 16*d* to open/close the pilot valve port (not shown). The solenoid valve 18 is connected to a controller 40 and causes the pilot valve 16*d* to move, based on a command signal from the controller 40. Specifically, the controller 40 receives a signal from the remote controller 6 or the human sensor 8 and sends an electrical signal to the solenoid valve 18 to cause the solenoid valve 18 to operate.

To the pilot valve 16*e*, a float switch 42 is connected. The float switch 42 is configured to control the pilot valve 16*e* based on a water level in the storage tank 10 to open/close a pilot valve port (not shown). In other words, when the water level in the storage tank 10 reaches a predetermined water level, the float switch 42 sends a signal to the pilot valve 16*e* to cause the pilot valve port (not shown) to be closed. In other words, the float switch 42 is configured to set the water storage level in the storage tank 10 to the predetermined stopped water level WL. The float switch 42 is arranged in the storage tank 10 and is configured to, when the water level in the storage tank 10 increases to the stopped water level WL, stop water supply from the water supply control valve 16 to the discharge valve hydraulic drive unit 14.

Further, the drive unit water supply passage 34*a* between the water supply control valve 16 and the discharge valve hydraulic drive unit 14 is provided with a vacuum breaker 36. When negative pressure occurs on the water supply control valve 16 side, backflow of water to the water supply control valve 16 side is prevented by the vacuum breaker 36.

The flush water amount control valve 22 is configured to control water supply to the control jet unit 20 based on operation of the solenoid valve 24. Though the flush water amount control valve 22 is connected to the water supply pipe 38 via the water supply control valve 16, tap water supplied from the water supply pipe 38 always flows into the flush water amount control valve 22 irrespective of whether the water supply control valve 16 is open or closed. The flush water amount control valve 22 is provided with a main valve body 22*a*, a pressure chamber 22*b* and a pilot valve 22*c*, and the pilot valve 22*c* is opened/closed by the solenoid valve 24. When the pilot valve 22*c* is opened by the solenoid valve 24, the main valve body 22*a* of the flush water amount control valve 22 is opened, and tap water flowing in from the water supply pipe 38 is supplied to the control jet unit 20 and jetted downward into the storage tank 10. Further, the solenoid valve 24 is connected to the controller 40 and causes the pilot valve 22*c* to move, based on a command signal from the controller 40. Specifically, the controller 40 sends an electrical signal to the solenoid valve 24 based on an operation of the remote controller 6 to cause the solenoid valve 24 to operate.

Further, a duct between the flush water amount control valve 22 and the control jet unit 20 is provided with a vacuum breaker 44. When negative pressure is generated on the flush water amount control valve 22 side, backflow of water to the flush water amount control valve 22 side is prevented by the vacuum breaker 44.

Water supplied from the tap water pipe is supplied to each of the water supply control valve 16 and the flush water amount control valve 22 via a stop cock 38*a* arranged outside the storage tank 10 and a fixed flow valve 38*b* arranged on the downstream side of the stop cock 38*a* in the storage tank 10. The stop cock 38*a* is provided to stop supply of water to the flush water tank apparatus 4 at the time of maintenance and the like, and is usually used in an open state. The fixed flow valve 38*b* is provided to cause water supplied from the tap water pipe to flow into the water supply control valve 16 and the flush water amount control valve 22 at a predetermined flow rate, and is configured so that water at a certain flow rate is supplied irrespective of the installation environment of the flush toilet apparatus 1.

Next, a configuration and operation of the clutch mechanism 30 will be described, newly referring to FIGS. 3A-3H.

FIGS. 3A-3H schematically shows the configuration of the clutch mechanism 30 and shows operation at the time of being pulled up by the discharge valve hydraulic drive unit 14.

Figure 3A:
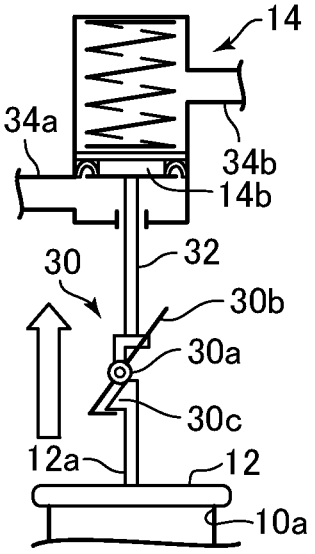
FIG. 3A is a diagram schematically showing a configuration and operation of a clutch mechanism provided in the flush water tank apparatus according to the embodiment of the present invention.

First, as shown in FIG. 3A, the clutch mechanism 30 is provided at the lower end of the rod 32 extending downward from the discharge valve hydraulic drive unit 14, and is configured so as to couple/release the lower end of the rod 32 and the upper end of the valve stem 12*a* of the discharge valve 12. The clutch mechanism 30 has a rotary shaft 30*a* attached to the lower end of the rod 32, a hook member 30*b* supported by the rotary shaft 30*a*, and an engaging claw 30*c* provided at the upper end of the valve stem 12*a*.

The rotary shaft 30*a* is attached at the lower end of the rod 32 in the horizontal direction and supports the hook member 30*b* in a rotatable state. The hook member 30*b* is a plate-shaped member, and an intermediate part of the hook member 30*b* is rotatably supported by the rotary shaft 30*a*. The lower end of the hook member 30*b* is bent in a hook shape to form a hook portion. The engaging claw 30*c* provided on the upper end of the valve stem 12*a* of the discharge valve 12 is a claw in a right-angle triangular shape. The base of the engaging claw 30*c* is almost in the horizontal direction, and the side face is formed to be sloped downward.

In the state shown in FIG. 3A, the discharge valve 12 seats on the drain port 10*a*, and the drain port 10*a* is blocked. In this state, the discharge valve hydraulic drive unit 14 and the discharge valve 12 are coupled. In this coupled state, the claw portion of the hook member 30*b* is engaged with the base of the engaging claw 30*c*, and the discharge valve 12 can be pulled up by the rod 32.

Figure 3B:
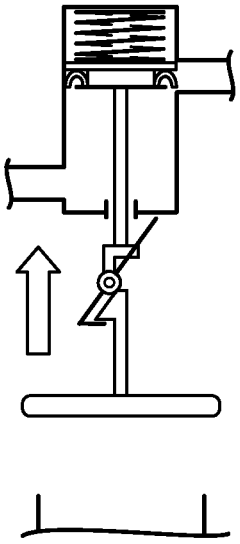
FIG. 3B is a diagram schematically showing a configuration and operation of a clutch mechanism provided in the flush water tank apparatus according to the embodiment of the present invention.
Figure 3C:
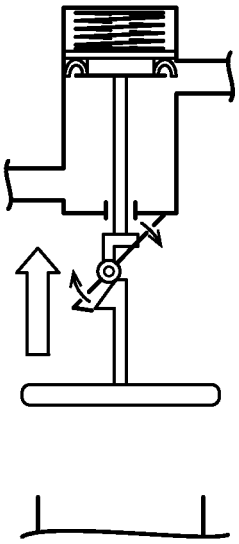
FIG. 3C is a diagram schematically showing a configuration and operation of a clutch mechanism provided in the flush water tank apparatus according to the embodiment of the present invention.
Figure 3D:
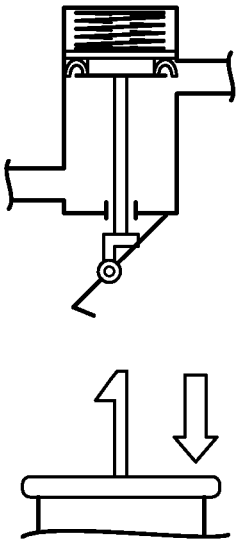
FIG. 3D is a diagram schematically showing a configuration and operation of a clutch mechanism provided in the flush water tank apparatus according to the embodiment of the present invention.

Next, as shown in FIG. 3B, when flush water is supplied to the discharge valve hydraulic drive unit 14, the piston 14*b* moves upward, and, accordingly, the discharge valve 12 is pulled up by the rod 32. Furthermore, as shown in FIG. 3C, when the discharge valve 12 is pulled up to a predetermined position, the upper end of the hook member 30*b* comes into contact with the bottom surface of the discharge valve hydraulic drive unit 14, and the hook member 30*b* is rotated around the rotary shaft 30*a*. By this rotation, the claw portion at the lower end of the hook member 30*b* is moved in a direction of disengaging from the engaging claw 30*c*, and engagement between the hook member 30*b* and the engaging claw 30*c* is released. When the engagement between the hook member 30*b* and the engaging claw 30*c* is released, the discharge valve 12 descends toward the drain port 10*a* in flush water stored in the storage tank 10 as shown in FIG. 3D. (Note that, as described later, the descended discharge valve 12 is temporarily held at a predetermined height by the first float device 26 or the second float device 28 before seating on the drain port 10*a*.)

Figure 3E:
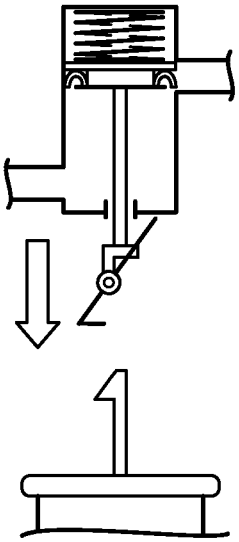
FIG. 3E is a diagram schematically showing a configuration and operation of a clutch mechanism provided in the flush water tank apparatus according to the embodiment of the present invention.
Figure 3F:
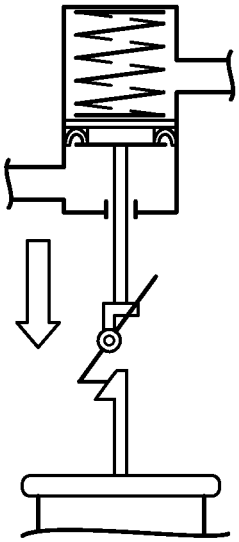
FIG. 3F is a diagram schematically showing a configuration and operation of a clutch mechanism provided in the flush water tank apparatus according to the embodiment of the present invention.
Figure 3G:
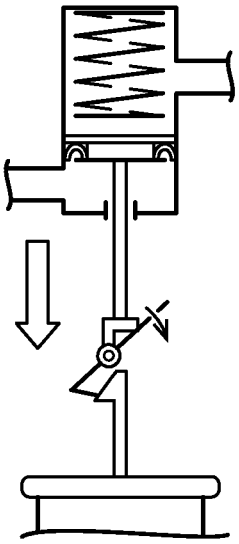
FIG. 3G is a diagram schematically showing a configuration and operation of a clutch mechanism provided in the flush water tank apparatus according to the embodiment of the present invention.
Figure 3H:
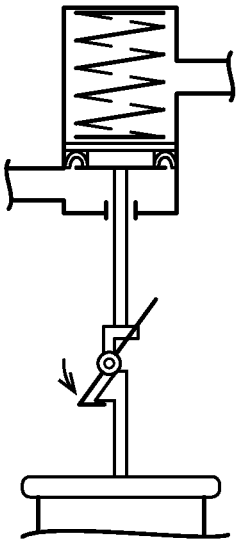
FIG. 3H is a diagram schematically showing a configuration and operation of a clutch mechanism provided in the flush water tank apparatus according to the embodiment of the present invention.

Furthermore, as shown in FIG. 3E, when flush water supplied to the discharge valve hydraulic drive unit 14 is stopped, the rod 32 descends due to the energizing force of the spring 14*c*. When the rod 32 descends, the distal end of the hook member 30*b* attached to the lower end of the rod 32 comes into contact with the engaging claw 30*c* as shown in FIG. 3F. When the rod 32 descends more, the claw portion of the hook member 30*b* is pushed by the sloped surface of the engaging claw 30*c* as shown in FIG. 3G, and the hook member 30*b* is rotated. When the rod 32 descends more, the claw portion of the hook member 30*b* gets over the engaging claw 30*c*, the hook member 30*b* is rotated to the original position by the gravity, and the claw portion of the hook member 30*b* and the engaging claw 30*c* engage with each other again as shown in FIG. 3H and return to the state shown in FIG. 3A.

Figure 4A:
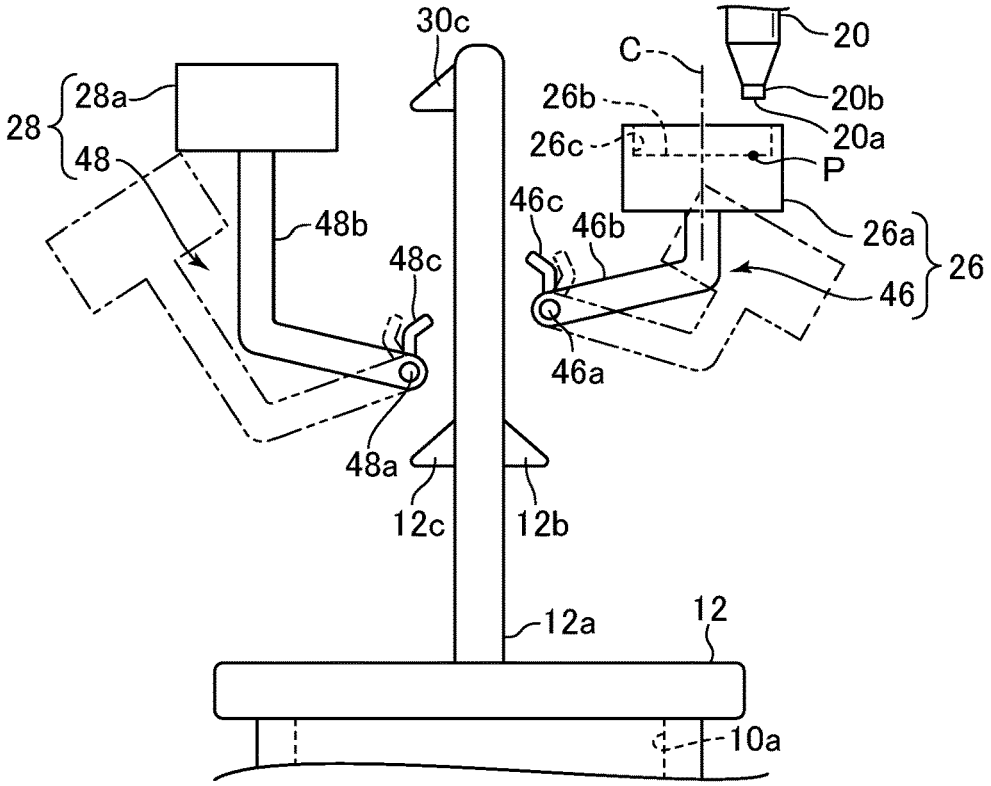
FIG. 4A is a diagram enlargingly showing a portion of a discharge valve, a first float device and a second float device provided for the flush water tank apparatus according to the embodiment of the present invention.
Figure 4B:
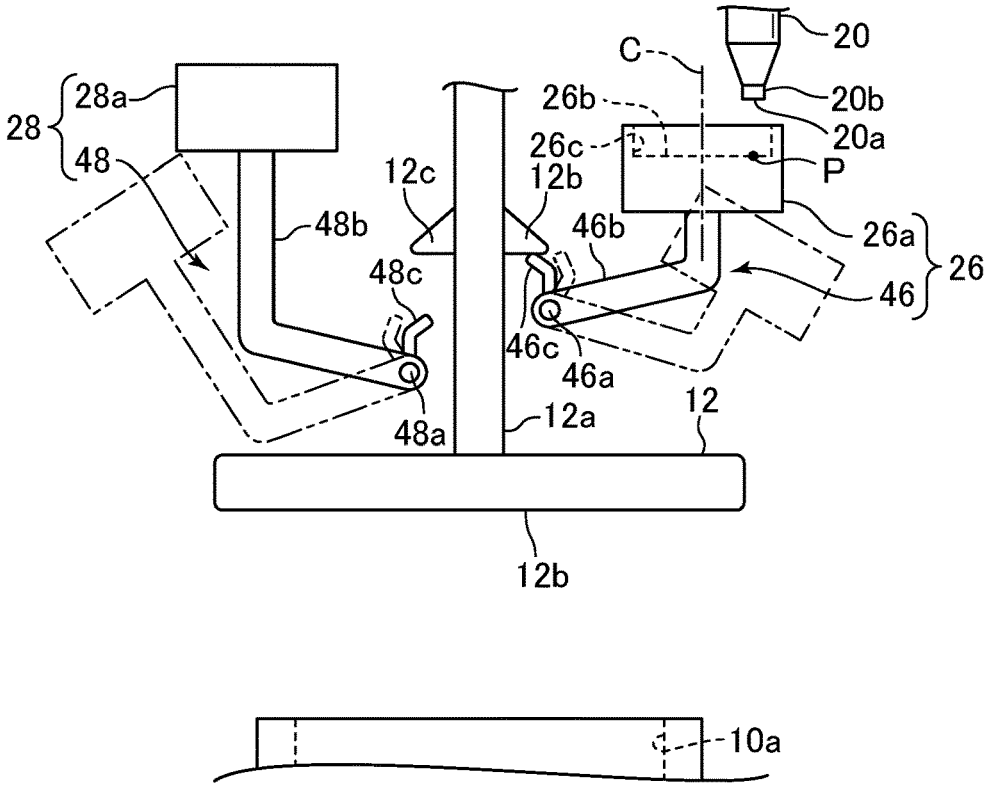
FIG. 4B is a diagram enlargingly showing a portion of a discharge valve, a first float device and a second float device provided for the flush water tank apparatus according to the embodiment of the present invention.

Next, configurations and operations of the first float device 26 and the second float device 28 will be described, newly referring to FIGS. 4A-4B. FIGS. 4A-4B is a diagram enlargingly showing the portion of the discharge valve 12, the first float device 26 and the second float device 28 in FIG. 2. A state in which the discharge valve 12 is closed is shown in FIG. 4A, and a state in which the discharge valve 12 is open and held by the first float device 26 is shown in FIG. 4B.

As shown in FIGS. 4A-4B, the first float device 26 has a first float 26*a* and a first holding mechanism 46 that supports the first float 26*a* in a rotatable state.

The first float 26*a* is a hollow rectangular parallelepiped member and is configured to receive buoyancy from flush water stored in the storage tank 10. When the water level in the storage tank 10 is a predetermined water level or above, the first float 26*a* is in the state shown by solid lines in FIG. 4A due to the buoyancy.

The first holding mechanism 46 is a mechanism that supports the first float 26*a* in a rotatable state and has a support shaft 46*a*, and an arm member 46*b* and a first engaging member 46*c* supported by the support shaft 46*a*. The support shaft 46*a* is a rotary shaft fixed to the storage tank 10 by an arbitrary member (not shown) and supports the arm member 46*b* and the first engaging member 46*c* in a rotatable state. At a proximal end portion of the valve stem 12*a* of the discharge valve 12, a holding claw 12*b* formed to be engageable with the first engaging member 46*c* is formed. The holding claw 12*b* is a projection in a right-angle triangular shape, which extends toward the first engaging member 46*c* from the proximal end portion of the valve stem 12*a*. Its base is in the horizontal direction, and its side face is formed to be sloped downward.

The support shaft 46*a* is a shaft extending in a direction orthogonal to the surface of FIGS. 4A-4B. Both of its end portions are fixed to the storage tank 10 by an arbitrary member (not shown), and an intermediate part is formed being curved to be away from the valve stem 12*a*. The arm member 46*b* is a beam-shaped member that is bent, and its lower end portion is configured to branch into two. These branched lower ends of the arm member 46*b* are rotatably supported by both end portions of the support shaft 46*a*, respectively. Therefore, even when the discharge valve 12 is moved in the vertical direction, it does not happen that the support shaft 46*a* and the arm member 46*b* interfere with the holding claw 12*b* provided on the valve stem 12*a* of the discharge valve 12.

An upper end portion of the arm member 46*b* is fixed to the bottom surface of the first float 26*a*. Therefore, in a state of receiving buoyancy, the first float 26*a* is held in the state shown by the solid lines in FIG. 4A. When the water level in the storage tank 10 drops, the first float 26*a* and the arm member 46*b* are rotated around the support shaft 46*a* due to their own weights up to a state shown by imaginary lines in FIG. 4A. Note that the rotation of the first float 26*a* and the arm member 46*b* is restricted to a range between the holding state of the first holding mechanism 46 shown by the solid lines in FIG. 4A and the non-holding state shown by the imaginary lines.

Furthermore, the first engaging member 46*c* is a member rotatably attached to the support shaft 46*a*, and its proximal end portion is rotatably supported by both end portions of the support shaft 46*a*. A distal end portion of the first engaging member 46*c* curvedly extends towards the valve stem 12*a* of the discharge valve 12. Therefore, in the state in which the first float 26*a* has been rotated to the position shown by the solid lines in FIG. 4A, the first engaging member 46*c* is positioned at an engaging position. In comparison, in the state in which the first float 26*a* has been rotated to the position shown by the imaginary lines in FIG. 4A, the first engaging member 46*c* is positioned at a non-engaging position.

The first engaging member 46*c* is configured to be rotated around the support shaft 46*a* in conjunction with the arm member 46*b*. In other words, when the first float 26*a* and the arm member 46*b* rotate from the state shown by the solid lines in FIG. 4A to the state shown by the imaginary lines, the first engaging member 46*c* is also rotated from the engaging position shown by the solid lines to the non-engaging position shown by the imaginary lines in conjunction with the arm member 46*b*. However, if the distal end of the first engaging member 46*c* is pushed upward by the holding claw 12*b* of the discharge valve 12 in the state shown by the solid lines in FIG. 4A, only the first engaging member 46*c* can rotate idle. In other words, when the distal end portion of the first engaging member 46*c* is pushed upward by the holding claw 12*b*, only the first engaging member 46*c* can rotate to the position shown by the imaginary lines of FIGS. 4A-4B while the first float 26*a* and the arm member 46*b* keep holding the position shown by the solid lines.

In the state in which the discharge valve 12 is pulled upward, and the holding claw 12*b* is positioned above the first engaging member 46*c* as shown by solid lines in FIG. 4B, the first engaging member 46*c* existing at the engaging position and the holding claw 12*b* engage with each other, so that descent of the discharge valve 12 is hindered, and the discharge valve 12 is held. In other words, the first engaging member 46*c* constituting the first holding mechanism 46 engages with the discharge valve 12 and holds the discharge valve 12 at a predetermined height. Therefore, the discharge valve 12 is pulled up by the rod 32 (FIGS. 3A-3H) connected to the discharge valve hydraulic drive unit 14, and, after that, the discharge valve 12 descends when the clutch mechanism 30 is disconnected. During the descent, the holding claw 12*b* of the discharge valve 12 and the first engaging member 46*c* existing at the engaging position engage with each other, and the discharge valve 12 is held at the predetermined height.

Then, when the water level in the storage tank 10 drops, the position of the first float 26*a* descends, and the first float 26*a* and the arm member 46*b* rotate to the position shown by imaginary lines in FIG. 4B (in this state, the second float device 28 has also been rotated to the position shown by the imaginary lines as described later). Since the first engaging member 46*c* is also rotated to the non-engaging position shown by the imaginary lines in FIG. 4B in conjunction with this rotation, engagement between the holding claw 12*b* and the first engaging member 46*c* is released. Thereby, the discharge valve 12 descends and seats on the drain port 10*a*, and the drain port 10*a* is blocked.

Further, as shown in FIG. 4A, the control jet unit 20 is provided above the first float 26*a*. The control jet unit 20 is a nozzle configured to jet flush water vertically downward to the first float 26*a*, and a jet port 20*a* for jetting flush water is provided on the lower end. Further, a straight pipe portion 20*b* in a cylindrical shape is provided at a lower end portion of the control jet unit 20, and the straight pipe portion 20*b* communicates with the jet port 20*a*. Disturbance of flush water jetted from the control jet unit 20 is suppressed by the flush water flowing in the straight pipe portion 20*b* with a circular cross section the cross-sectional area of which is constant. Note that, when water is still in the storage tank 10, distal end portions of the first float 26*a* and the control jet unit 20 are in a state of being submerged in the flush water. Therefore, flush water is jetted from the jet port 20*a* of the submerged control jet unit 20 toward the submerged first float 26*a*.

Furthermore, the flush water jetted from the control jet unit 20 hits an upper surface 26*b* of the first float 26*a* oriented to face the jet port 20*a* and acts to push down the first float 26*a*. Therefore, the upper surface 26*b* of the first float 26*a* functions as a water receiving surface where the flush water jetted from the control jet unit 20 hits. By causing flush water to be jetted from the control jet unit 20 and causing the flush water to hit the water receiving surface of the first float 26*a*, the first engaging member 46*c* of the first float device 26 is moved to the non-engaging position shown by the imaginary lines in FIGS. 4A-4B irrespective of the water level in the storage tank 10. Therefore, the control jet unit 20 functions as a float driving mechanism that causes the first engaging member 46*c* to move to the non-engaging position. Furthermore, in the present embodiment, the first float device 26 functions as a timing control mechanism for controlling a timing of the discharge valve 12 descending and the drain port 10*a* being blocked, and it is possible to control the timing of the drain port 10*a* being blocked by jetting flush water to the water receiving of the timing control mechanism. Further, since the area of the jet port 20*a* is formed smaller than the area of the upper surface 26*b* of the first float 26*a*, which is a water receiving surface, kinetic energy of water jetted from the jet port 20*a* is received by the upper surface 26*b* without dissipation.

Further, a wall surface 26*c* is provided on an outer periphery of the upper surface 26*b* of the first float 26*a*. The wall surface 26*c* is provided surrounding a collision point P at which flush water jetted from the control jet unit 20 hits the upper surface 26*b*. Thereby, it becomes difficult for flush water hitting the upper surface 26*b* of the first float 26*a* to escape from the upper surface 26*b*, and it is possible to transmit kinetic energy of the flush water to the upper surface 26*b* more effectively. The collision point P at which flush water hits the upper surface 26*b* is positioned on a side away from the support shaft 46*a*, relative to a center line C of the first float 26*a*. Since flush water jetted from the control jet unit 20 collides against the side away from the support shaft 46*a* relative to the center line C of the first float 26*a* as described above, it is possible to increase the moment of force around the support shaft 46*a*, which acts by the flush water colliding.

Next, the second float device 28 will be described with reference to FIGS. 4A-4B.

As shown in FIGS. 4A-4B, the second float device 28 has a second float 28*a* and a second holding mechanism 48 that supports the second float 28*a* in a rotatable state, and is arranged on an opposite side of the first float device 26, with the valve stem 12*a* of the discharge valve 12 between the second float device 28 and the first float device 26.

The second float 28*a* is a hollow rectangular parallelepiped member and is configured to receive buoyancy from water stored in the storage tank 10. When the water level in the storage tank 10 is a predetermined water level or above, the second float 28*a* is in the holding state shown by the solid lines in FIG. 4A due to the buoyancy.

The second holding mechanism 48 is a mechanism that supports the second float 28*a* in a rotatable state and has a support shaft 48*a*, and an arm member 48*b* and a second engaging member 48*c* supported by the support shaft 48*a*. The configuration and operation of the second holding mechanism 48 is similar to those of the first holding mechanism 46. The second engaging member 48*c* constituting the second holding mechanism 48 is arranged to engage with a holding claw 12*c* provided on the valve stem 12*a* of the discharge valve 12. The holding claw 12*c* is also a projection in a right-angle triangular shape similarly to the holding claw 12*b* with which the first engaging member 46*c* of the first holding mechanism 46 engages, and is formed on the valve stem 12*a* of the discharge valve 12 at the same height as the holding claw 12*b*. The second engaging member 48*c* is positioned at the engaging position when the second float 28*a* and the arm member 48*b* are in the state shown by the solid lines in FIGS. 4A-4B, and is positioned at the non-engaging position when they are in the state shown by the imaginary lines.

The support shaft 48*a* of the second holding mechanism 48 is arranged at a position lower than the support shaft 46*a* of the first holding mechanism 46. Therefore, the second float device 28 holds the discharge valve 12 at a position different from a position by the first float device 26, a position lower than the position by the first float device 26. Furthermore, since the arm member 48*b* of the second holding mechanism 48 is formed longer than the arm member 46*b* of the first holding mechanism 46, the second float 28*a* is supported at a position higher than the first float 26*a*. Thereby, when the water level in the water storage tank 10 is low, the second float 28*a* is rotated to the position of the non-holding state shown by the imaginary lines in FIGS. 4A-4B earlier than the first float 26*a*.

Next, a description will be made on operation of the flush water tank apparatus 4 according to the embodiment of the present invention and operation of the flush toilet apparatus 1 provided with the flush water tank apparatus 4, newly referring to FIGS. 5 to 9.

First, in the toilet washing standby state shown in FIG. 2, the water level in the storage tank 10 is at the predetermined stopped water level WL. In this state, both of the water supply control valve 16 and the flush water amount control valve 22 are closed. The first float device 26 and the second float device 28 are in the holding state shown by the solid lines in FIG. 4A. Next, when the user pushes a large washing button on the remote controller 6 (FIG. 1), the remote controller 6 transmits an instruction signal for executing the large washing mode to the controller 40 (FIG. 2). When a small washing button is pushed, an instruction signal for executing the small washing mode is transmitted to the controller 40. Thus, in the present embodiment, the flush toilet apparatus 1 is provided with the two washing modes, the large washing mode and the small washing mode with different amounts of flush water, and the remote controller 6 functions as the flush water amount selection device for selecting the amount of flush water.

Note that, in the flush toilet apparatus 1 of the present embodiment, if a predetermined time passes without the washing button on the remote controller 6 not being pressed after it is detected by the human sensor 8 (FIG. 1) that the user has left the toilet seat, an instruction signal for toilet washing is also transmitted to the controller 40. Further, if a time from the user sitting on the toilet seat until leaving the toilet seat is shorter than a predetermined time, the controller 40 judges that the user has urinated and executes the small washing mode. On the other hand, if the time from sitting on the toilet seat until leaving the toilet seat is longer than the predetermined time, the controller 40 executes the large washing mode. Therefore, in this case, since the large washing for performing washing with the first amount of flush water or the small washing for performing washing with the second amount of flush water is selected by the controller 40, the controller 40 functions as the flush water amount selection device.

Next, operation of the large washing mode will be described with reference to FIGS. 5 to 7.

Figure 5A:
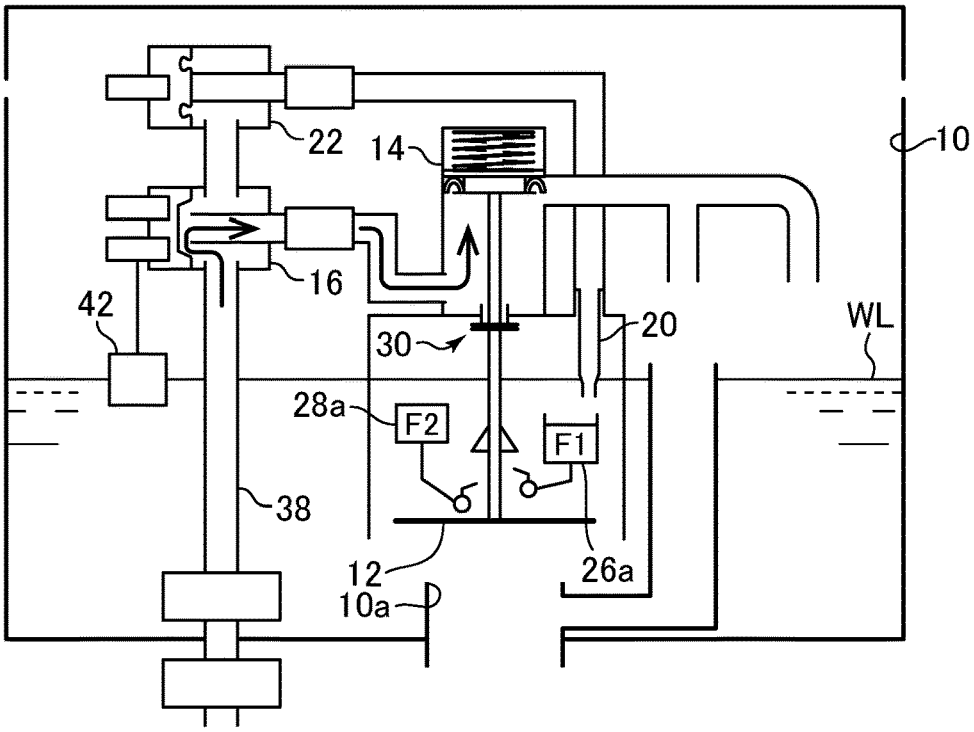
FIG. 5A is a diagram showing operation in a large washing mode of the flush water tank apparatus according to the embodiment of the present invention.

When receiving an instruction signal to perform large washing, the controller 40 causes the solenoid valve 18 (FIG. 2) provided for the water supply control valve 16 to operate to cause the pilot valve 16*d* on the solenoid valve side to leave from the pilot valve port. Thereby, the pressure in the pressure chamber 16*c* drops; the main valve body 16*a* leaves from the main valve port 16*b*; and the main valve port 16*b* is opened. Note that, when large washing is selected, the flush water amount control valve 22 is continuously in the closed state, and flush water is not jetted from the control jet unit 20. In other words, when large washing is selected, the first float 26*a* is not driven by the control jet unit 20 which is a float driving mechanism. When the water supply control valve 16 is opened, flush water flowing in from the water supply pipe 38 is supplied to the discharge valve hydraulic drive unit 14 via the water supply control valve 16 as shown in FIG. 5A. Thereby, the piston 14*b* of the discharge valve hydraulic drive unit 14 is pushed up; the discharge valve 12 is pulled up via the rod 32; and flush water in the storage tank 10 is discharged from the drain port 10*a* to the flush toilet main body 2.

Figure 5B:
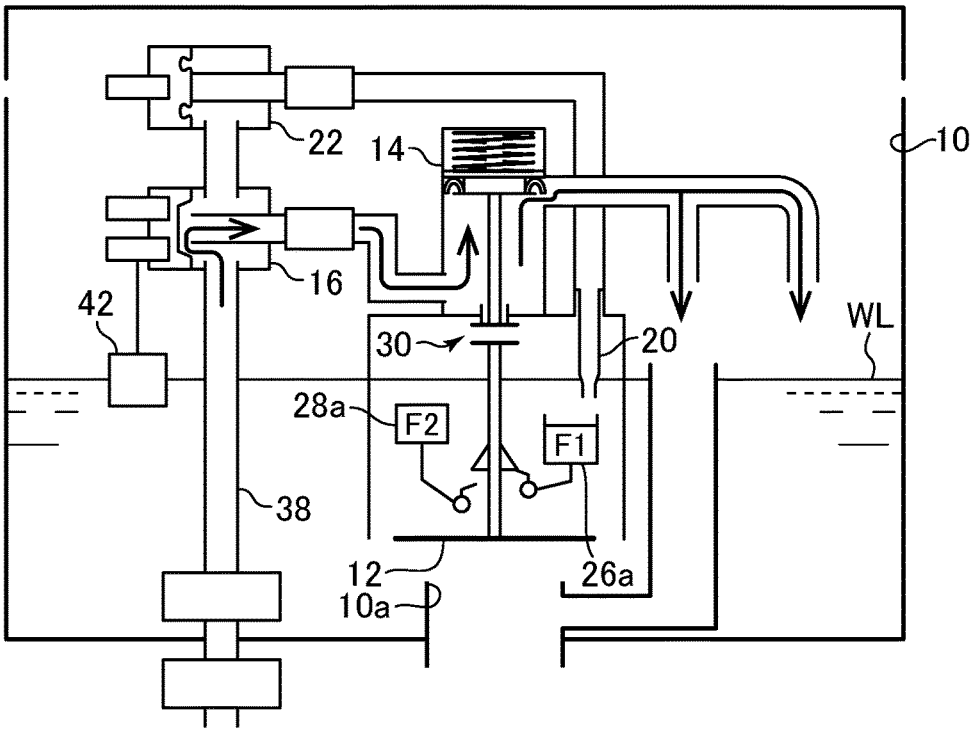
FIG. 5B is a diagram showing operation in a large washing mode of the flush water tank apparatus according to the embodiment of the present invention.

When the discharge valve 12 is pulled up, the holding claw 12*c* provided on the valve stem 12*a* of the discharge valve 12 pushes up and rotates the second engaging member 48*c* of the second holding mechanism 48, and the holding claw 12*c* gets over the second engaging member 48*c*. When the discharge valve 12 is further pulled up, the holding claw 12*b* pushes up and rotates the first engaging member 46*c* of the first holding mechanism 46, and the holding claw 12*b* gets over the first engaging member 46*c* (FIG. 4A→FIG. 4B). Next, when the discharge valve 12 is further pulled up, the clutch mechanism 30 is disconnected as shown in FIG. 5B. In other words, when the discharge valve 12 reaches a predetermined height, the upper end of the hook member 30*b* of the clutch mechanism 30 hits the bottom surface of the discharge valve hydraulic drive unit 14, and the clutch mechanism 30 is disconnected (FIG. 3B→FIG. 3C).

When the clutch mechanism 30 is disconnected, the discharge valve 12 starts to descend toward the drain port 10*a* due to its own weight. Here, since the water level in the storage tank 10 is high immediately after the discharge valve 12 is opened, both of the first engaging member 46*c* of the first float device 26 and the second engaging member 48*c* of the second float device 28 are at the engaging positions shown by the solid lines in FIG. 4B. Therefore, the holding claw 12*b* of the discharge valve 12 that has descended engages with the first engaging member 46*c* of the first holding mechanism 46, and the discharge valve 12 is held at a predetermined height by the first float device 26. By the discharge valve 12 being held by the first float device 26, the drain port 10*a* is kept in the open state, and discharge of flush water in the storage tank 10 to the flush toilet main body 2 is kept.

Figure 6A:
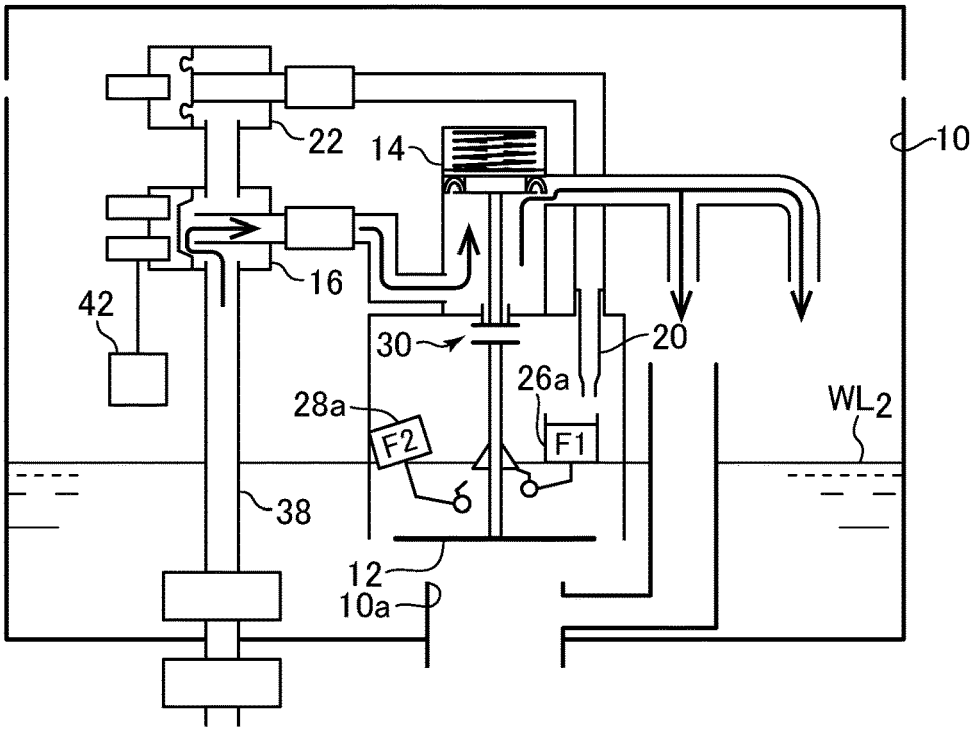
FIG. 6A is a diagram showing the operation in the large washing mode of the flush water tank apparatus according to the embodiment of the present invention.

Then, when the water level in the storage tank 10 drops as shown in FIG. 6A, the float switch 42 that detects the water level in the storage tank 10 is turned off. When the float switch 42 is turned off, the pilot valve 16*e* (FIG. 2) on the float switch side, which is provided for the water supply control valve 16, is opened. When the pilot valve 16*e* is opened, the controller 40 causes the solenoid valve 18 to operate to close the pilot valve 16*d* on the solenoid valve side. As described above, the main valve body 16*a* of the water supply control valve 16 is configured to be closed when both of the pilot valve 16*e* on the float switch side and the pilot valve 16*d* on the solenoid valve side are closed. Therefore, even after the pilot valve 16*d* on the solenoid valve side is closed, the open state of the water supply control valve 16 is kept, and water supply to the storage tank 10 is continued.

Note that, though the pilot valve 16*e* is opened/closed based on a detection signal of the float switch 42 in the present embodiment, the present invention can be configured so that the pilot valve 16*e* is mechanically opened/closed by a ball tap instead of the float switch 42, as a modification. In this modification, the pilot valve 16*e* is opened/closed in conjunction with a float that moves up and down according to the water level in the storage tank 10. Meanwhile, in this modification, the pilot valve 16*d* on the solenoid valve side is closed after the water level in the water storage tank 10 drops after start of washing, and enough time for the pilot valve 16*e* to be opened passes.

As shown in FIG. 6A, when the water level in the storage tank 10 drops to a predetermined water level WL2, the position of the second float 28*a* supported by the second holding mechanism 48 descends. Thereby, the second engaging member 48*c* of the second float device 28 moves to the non-engaging position shown by the imaginary lines in FIG. 4B. Even in this state, the first engaging member 46*c* of the first float device 26 is kept at the engaging position because the first float 26*a* is supported at a position lower than the second float 28*a*, and flush water in the storage tank 10 continues to be discharged.

Figure 6B:
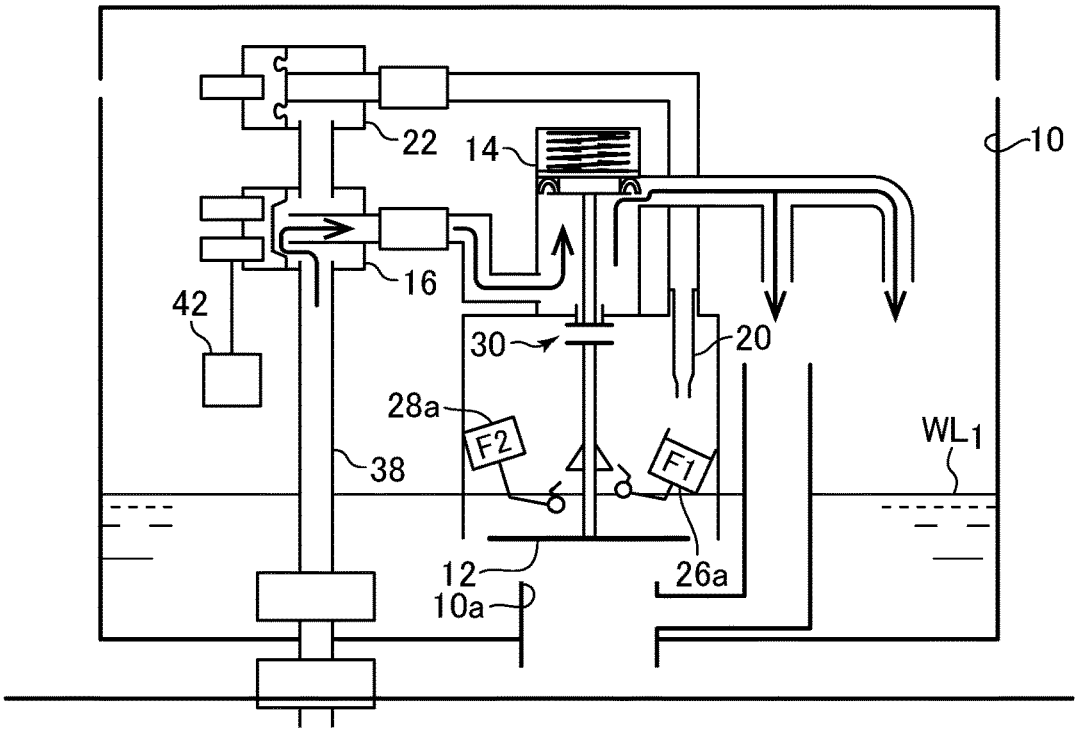
FIG. 6B is a diagram showing the operation in the large washing mode of the flush water tank apparatus according to the embodiment of the present invention.

When the water level in the storage tank 10 further drops and reaches a predetermined water level WL1 lower than the predetermined water level WL2, the position of the first float 26*a* supported by the first holding mechanism 46 also drops as shown in FIG. 6B. Thereby, the first engaging member 46*c* of the first float device 26 also moves to the non-engaging position shown by the imaginary lines in FIG. 4B, and engagement between the first engaging member 46*c* and the holding claw 12*b* of the discharge valve 12 is released. By the first engaging member 46*c* moving to the non-engaging position, the discharge valve 12 starts to descend again.

Figure 7A:
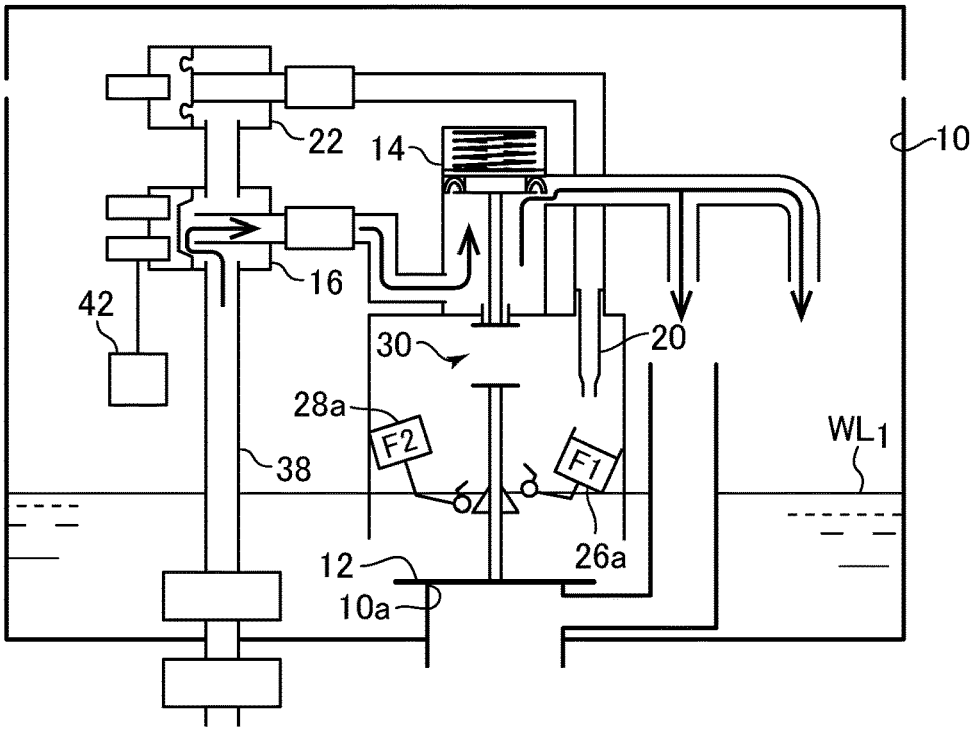
FIG. 7A is a diagram showing the operation in the large washing mode of the flush water tank apparatus according to the embodiment of the present invention.

Thereby, the discharge valve 12 seats on the drain port 10*a*, and the drain port 10*a* is blocked as shown in FIG. 7A. Thus, when the large washing mode is executed, the discharge valve 12 is held until the water level in the storage tank 10 drops from the stopped water level WL to the predetermined water level WL1, and the first amount of flush water is discharged to the flush toilet main body 2.

Since the float switch 42 is still in the off state, the open state of the water supply control valve 16 is kept, and water supply to the storage tank 10 is continued. Flush water supplied to the storage tank 10 passes through the discharge valve hydraulic drive unit 14 and reaches the discharge passage branch portion 34*c* (FIG. 2), and a part of the flush water branched at the discharge passage branch portion 34*c* flows into the overflow pipe 10*b*, and the remaining flush water is stored in the storage tank 10. The flush water flowing into the overflow pipe 10*b* flows into the flush toilet main body 2 and is used to refill the bowl 2*a*. By flush water flowing into the storage tank 10 in the state of the discharge valve 12 being closed, the water level in the storage tank 10 rises.

Figure 7B:
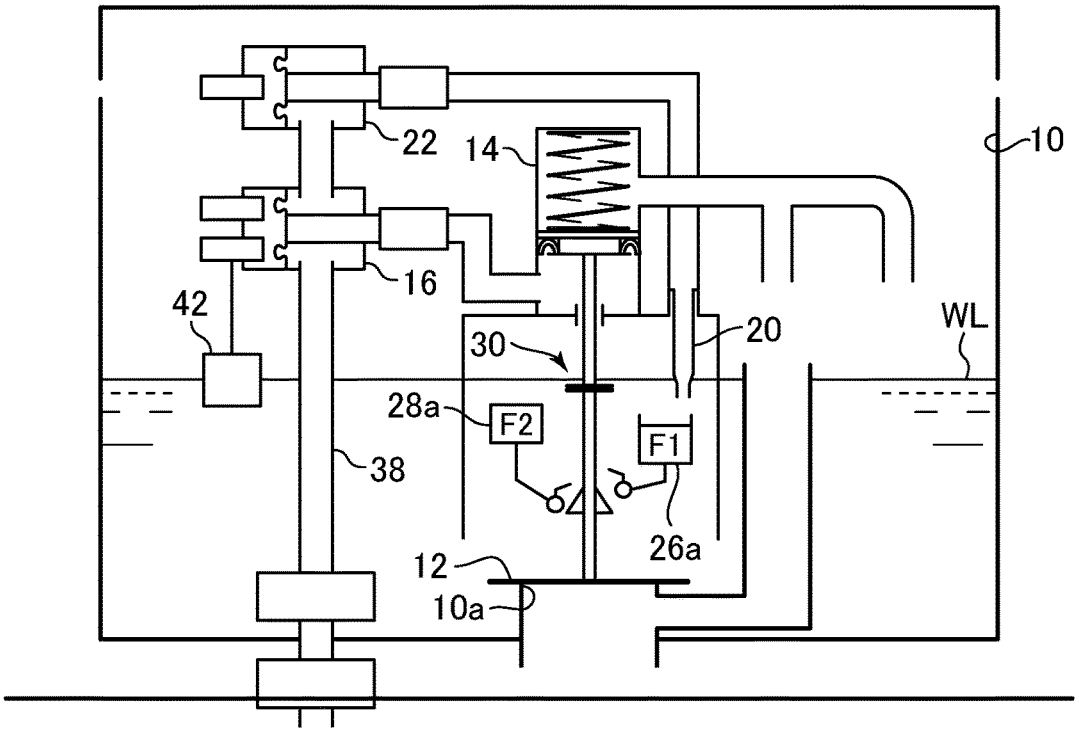
FIG. 7B is a diagram showing the operation in the large washing mode of the flush water tank apparatus according to the embodiment of the present invention.

When the water level in the storage tank 10 rises to the predetermined stopped water level WL as shown in FIG. 7B, the float switch 42 is turned on. When the float switch 42 is turned on, the pilot valve 16*e* (FIG. 2) on the float switch side is closed. Thereby, both of the pilot valve 16*e* on the float switch side and the pilot valve 16*d* on the solenoid valve side enter the closed state. Therefore, the pressure in the pressure chamber 16*c* rises, the main valve body 16*a* of the water supply control valve 16 is closed, and water supply is stopped. When water supply to the discharge valve hydraulic drive unit 14 is stopped, the piston 14*b* of the discharge valve hydraulic drive unit 14 is pushed down by the energizing force of the spring 14*c*, and, simultaneously, the rod 32 descends. Thereby, the clutch mechanism 30 is connected (FIG. 3E to FIG. 3H), and the standby state before starting toilet washing is returned to.

Next, operation of the small washing mode will be described with reference to FIGS. 8A-8B, and FIGS. 9A-9B.

Figure 8A:
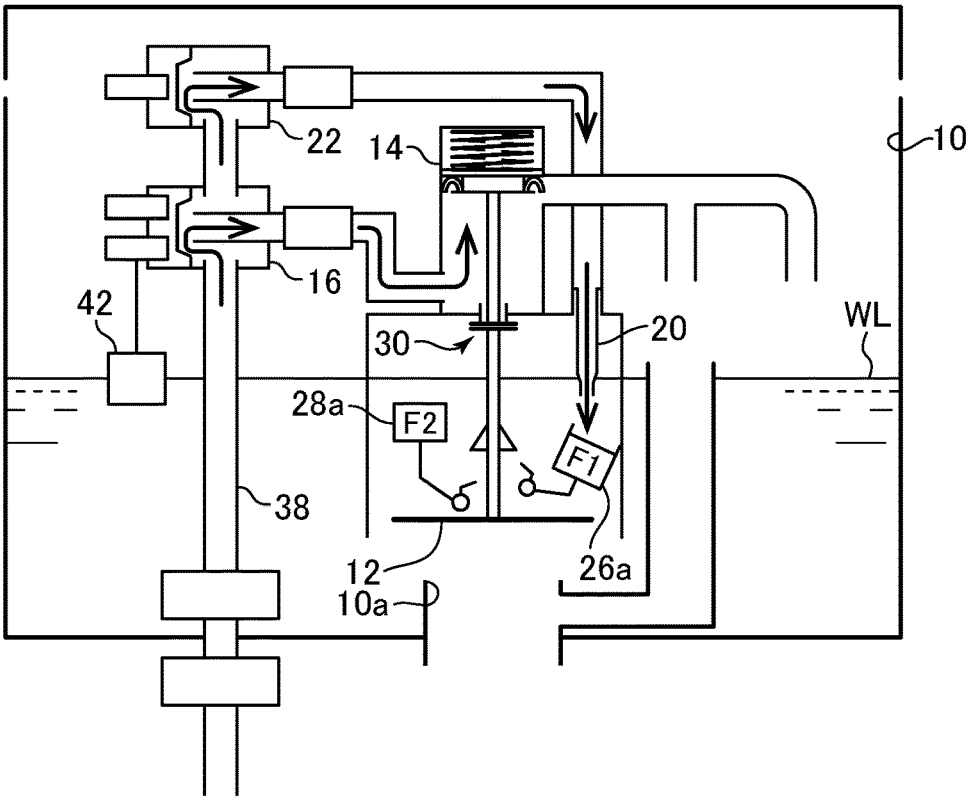
FIG. 8A is a diagram showing the operation in the small washing mode of the flush water tank apparatus according to the embodiment of the present invention.

When receiving an instruction signal to perform small washing, the controller 40 causes the solenoid valve 18 provided for the water supply control valve 16 to operate to open the water supply control valve 16. Furthermore, the controller 40 causes the solenoid valve 24 (FIG. 2) provided for the flush water amount control valve 22 to operate to also open the flush water amount control valve 22. When the water supply control valve 16 is opened, flush water flowing in from the water supply pipe 38 is supplied to the discharge valve hydraulic drive unit 14 via the water supply control valve 16 as shown in FIG. 8A. Thereby, the piston 14*b* of the discharge valve hydraulic drive unit 14 is pushed up; the discharge valve 12 is pulled up via the rod 32; and flush water in the storage tank 10 is discharged from the drain port 10*a* to the flush toilet main body 2. Note that, when the discharge valve 12 is pulled up, the holding claw 12*c* (FIG. 4A) provided on the valve stem 12*a* of the discharge valve 12 pushes up and rotates the second engaging member 48*c* of the second holding mechanism 48, and the holding claw 12*c* gets over the second engaging member 48*c*.

When the flush water amount control valve 22 is opened, flush water flowing in from the water supply pipe 38 passes through the flush water amount control valve 22 and is jetted downward from the control jet unit 20. Note that, since the distal end (the lower end) of the control jet unit 20 is positioned below the stopped water level WL of the storage tank 10, the control jet unit 20 jets flush water from the jet port 20*a* that is submerged (FIGS. 4A-4B). The flush water jetted from the jet port 20*a* hits the upper surface 26*b* of the first float 26*a*, which is a water receiving surface and is arranged to face the jet port 20*a*, and drives the first float 26*a* downward. Therefore, while flush water is jetted from the jet port 20*a* of the control jet unit 20, the first float 26*a* is pushed down to the position shown by the imaginary lines in FIG. 4A irrespective of the water level in the water storage tank 10. As described above, the control jet unit 20, which is a float driving mechanism, drives the first float 26*a* using supplied tap water.

In other words, as shown in FIG. 8A, the first engaging member 46*c* of the first float device 26 is moved to the non-engaging position irrespective of the water level in the water storage tank 10, by flush water jetted from the control jet unit 20. Note that, before the discharge valve 12 is pulled up to the height at which the first engaging member 46*c* of the first float device 26 and the holding claw 12*b* of the discharge valve 12 engage with each other, the first float 26*a* is driven by jet of flush water from the control jet unit 20, and the first engaging member 46*c* is moved to the non-engaging position.

Figure 8B:
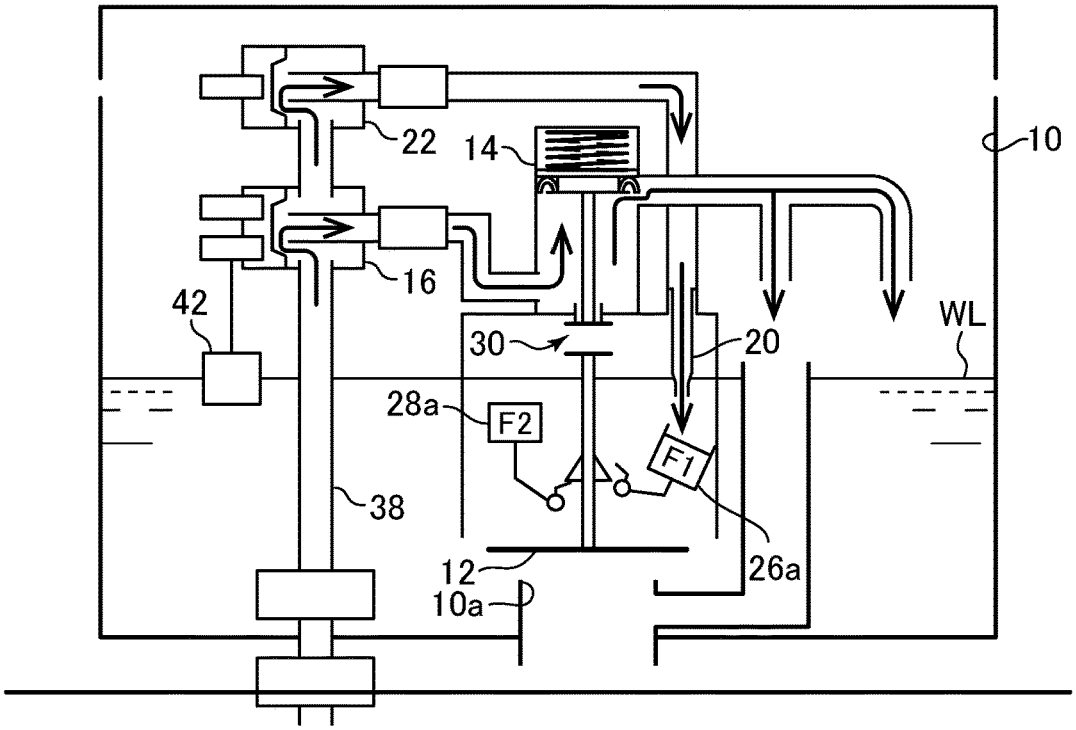
FIG. 8B is a diagram showing the operation in the small washing mode of the flush water tank apparatus according to the embodiment of the present invention.

Next, as shown in FIG. 8B, when the discharge valve 12 is pulled up to a predetermined position, the clutch mechanism 30 is disconnected. In other words, the clutch mechanism 30 is disconnected at a position higher than the height at which the first engaging member 46*c* of the first float device 26 and the discharge valve 12 engage with each other. Further, as described above, the first float 26*a* has already been moved (pushed down) by flush water jetted from the control jet unit 20, and the first engaging member 46*c* has been moved to the non-engaging position before the discharge valve 12 descends to the height at which the first engaging member 46*c* and the holding claw 12*b* of the discharge valve 12 engage with each other.

When the clutch mechanism 30 is disconnected, the discharge valve 12 starts to descend toward the drain port 10*a* due to its own weight. Here, since the water level in the storage tank 10 is high immediately after the discharge valve 12 is opened, the second engaging member 48*c* of the second float device 28 is at the engaging position shown by the solid lines in FIG. 4B. Meanwhile, the first engaging member 46*c* of the first float device 26 has been moved to the non-engaging position shown by the imaginary lines in FIG. 4B by jet of flush water from the control jet unit 20 as described above, and the state is kept. In other words, after the clutch mechanism 30 is disconnected, the first engaging member 46*c* is kept at the non-engaging position by jet of flush water from the control jet unit 20 until the discharge valve 12 descends below the height at which the first engaging member 46*c* of the first float device 26 and the holding claw 12*b* of the discharge valve 12 engage with each other. Therefore, the holding claw 12*c* of the discharge valve 12 that has descended engages with the second engaging member 48*c* of the second holding mechanism 48, and the discharge valve 12 is held at a predetermined height by the second holding mechanism 48.

Here, when being held by the second holding mechanism 48, the discharge valve 12 is held at a position lower than the case of being held by the first holding mechanism 46. By the discharge valve 12 being held by the second holding mechanism 48, the drain port 10*a* is kept in the open state, and discharge of flush water in the storage tank 10 to the flush toilet main body 2 is kept. After the discharge valve 12 descends, and the holding claw 12*b* of the discharge valve 12 passes the first engaging member 46*c* of the first holding mechanism 46, the controller 40 sends a signal to the solenoid valve 24 (FIG. 2) at a predetermined timing to cause the flush water amount control valve 22 to be closed. Thereby, jet of flush water from the control jet unit 20 is stopped.

Figure 9A:
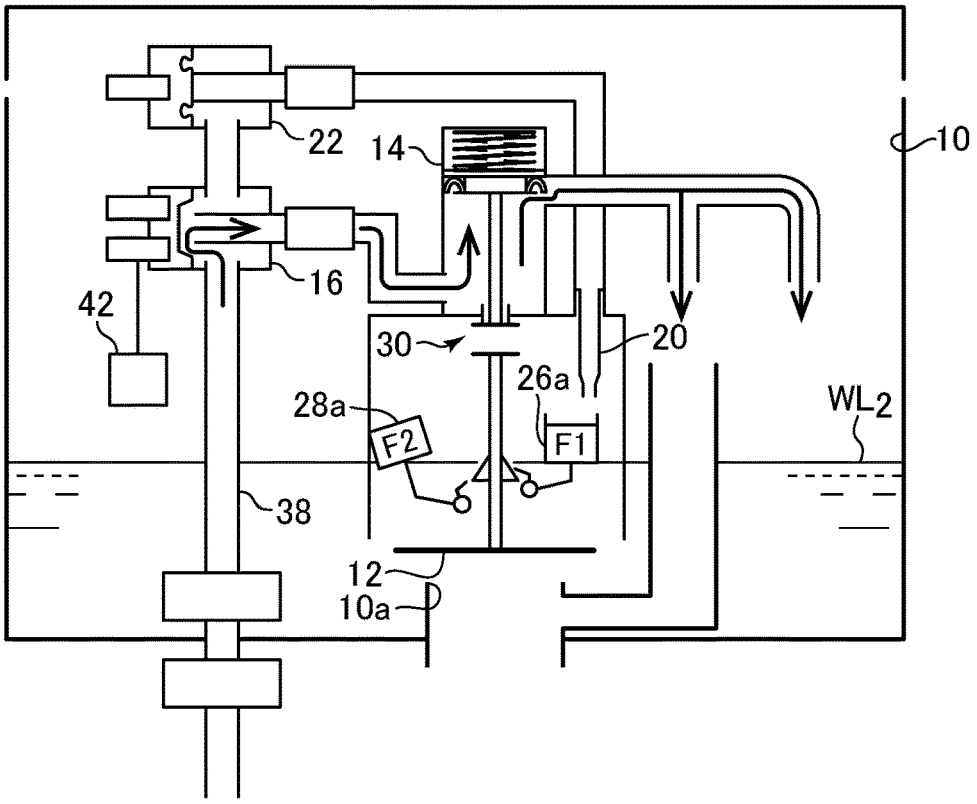
FIG. 9A is a diagram showing the operation in the small washing mode of the flush water tank apparatus according to the embodiment of the present invention.

Then, when the water level in the storage tank 10 drops as shown in FIG. 9A, the float switch 42 that detects the water level in the storage tank 10 is turned off. When the float switch 42 is turned off, the pilot valve 16*e* (FIG. 2) on the float switch side, which is provided for the water supply control valve 16, is opened. When the pilot valve 16*e* is opened, the controller 40 causes the solenoid valve 18 to operate to cause the pilot valve 16*d* on the solenoid valve side to be closed. Thereby, even after the pilot valve 16*d* on the solenoid valve side is closed, the open state of the water supply control valve 16 is kept, and water supply to the storage tank 10 is continued.

As shown in FIG. 9A, when the water level in the storage tank 10 drops, the position of the second float 28*a* supported by the second holding mechanism 48 drops. Thereby, the second engaging member 48*c* of the second float device 28 moves to the non-engaging position shown by the imaginary lines in FIG. 4B. Thereby, engagement between the second engaging member 48*c* and the holding claw 12*c* of the discharge valve 12 is released. In other words, before the second engaging member 48*c* is moved to the non-engaging position in conjunction with the second float 28*a*, the first float 26*a* has been driven by flush water jetted from the control jet unit 20, and the first engaging member 46*c* has been moved to the non-engaging position. Therefore, the discharge valve 12 does not engage with the first engaging member 46*c* but engages with the second engaging member 48*c* below the first engaging member 46*c*. Then, by the second engaging member 48*c* of the second float device 28 moving to the non-engaging position, the discharge valve 12 starts to descend again.

Figure 9B:
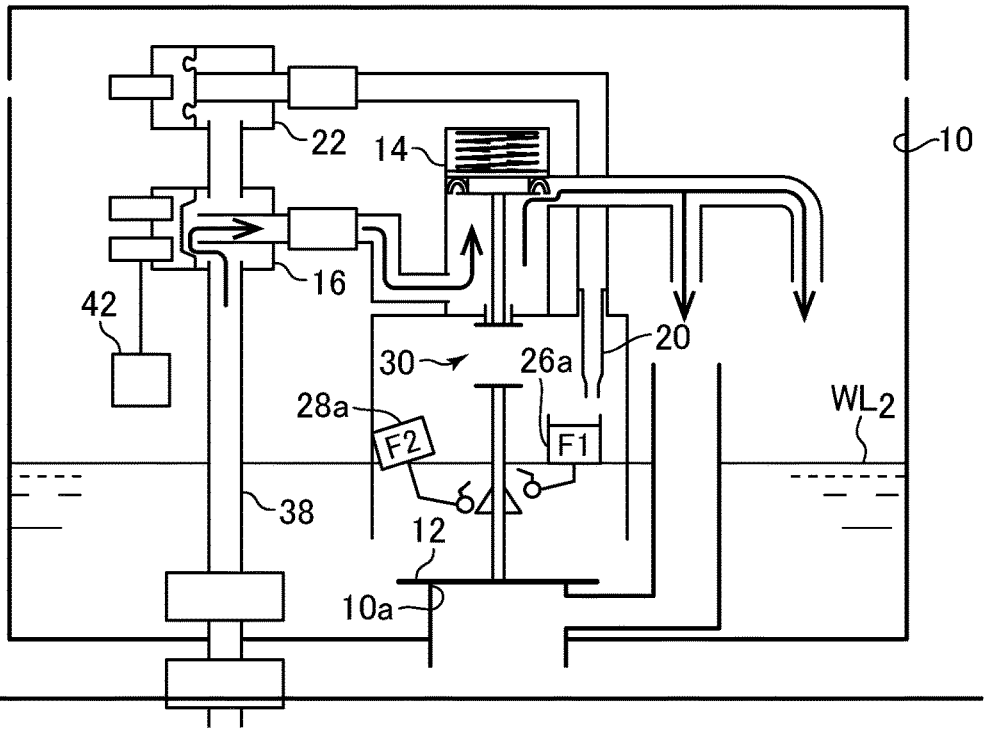
FIG. 9B is a diagram showing the operation in the small washing mode of the flush water tank apparatus according to the embodiment of the present invention.

Then, the discharge valve 12 seats on the drain port 10*a*, and the drain port 10*a* is blocked as shown in FIG. 9B. Thus, when the small washing mode is executed, the discharge valve 12 is held until the water level in the storage tank 10 drops from the stopped water level WL to the predetermined water level WL2, and the second amount of flush water is discharged to the flush toilet main body 2. In the large washing mode, the discharge valve 12 is held until the water level in the water storage tank 10 descends to the predetermined water level WL1 lower than the predetermined water level WL2. Therefore, the second amount of flush water discharged from the storage tank 10 in the small washing mode is smaller than the first amount of flush water discharged in the large washing mode. In other words, in the small washing mode, the first holding mechanism 46 is caused to be in the non-holding state by the control jet unit 20 jetting flush water to the first float 26*a*, and the discharge valve 12 is not held by the first holding mechanism 46 but held by the second holding mechanism 48. As a result, in the small washing mode, the discharge valve 12 is caused to descend earlier than the case of the large washing mode, and the amount of flush water is smaller.

In the state of FIG. 9B, since the float switch 42 is still in the off state, the open state of the water supply control valve 16 is kept, and water supply to the storage tank 10 is continued. By flush water flowing into the storage tank 10 in the state of the discharge valve 12 being closed, the water level in the storage tank 10 rises.

Furthermore, when the water level in the storage tank 10 rises to the predetermined stopped water level WL, the float switch 42 is turned on, and the pilot valve 16*e* (FIG. 2) on the float switch side is closed. Thereby, both of the pilot valve 16*e* on the float switch side and the pilot valve 16*d* on the solenoid valve side enter the closed state. Therefore, the main valve body 16*a* of the water supply control valve 16 is closed, and water supply is stopped. When water supply to the discharge valve hydraulic drive unit 14 is stopped, the piston 14*b* of the discharge valve hydraulic drive unit 14 is pushed down, and, at the same time, the rod 32 descends. Thereby, the clutch mechanism 30 is connected (FIG. 3E to FIG. 3H); the standby state before starting toilet washing is returned to (the state in FIG. 7B is returned to); and the small washing mode is ended.

According to the flush water tank apparatus 4 of the embodiment of the present invention, since the discharge valve 12 and the discharge valve hydraulic drive unit 14 are coupled by the clutch mechanism 30 and disconnected at a predetermined timing (FIGS. 3A-3H), it becomes possible to cause the discharge valve 12 to move irrespective of the operation speed of the discharge valve hydraulic drive unit 14 and cause the discharge valve 12 to be closed. Further, since the control jet unit 20, which is a float driving mechanism, drives the first float 26*a* to cause the first engaging member 46*c* to move to the non-engaging position, it is possible to selectively cause the first float device 26 (in the case of large washing) or the second float device 28 (in the case of small washing) according to a selected amount of flush water. Thereby, it is possible to set the first or second amount of flush water using the clutch mechanism 30.

Further, according to the flush water tank apparatus 4 of the present embodiment, the first float device 26 is configured to hold the discharge valve 12 at a position higher than a position by the second float device 28 (FIGS. 4A-4B), and the float driving mechanism 20 drives the first float 26*a* to cause the first engaging member 46*c* to move to the non-engaging position (FIG. 8A). Therefore, when the control jet unit 20 does not normally operate, and the first float 26*a* cannot be pushed down, the discharge valve 12 is held by the first float device 26 similarly to the case of large washing (FIG. 6A). As a result, when the control jet unit 20 does not normally operate, the first amount of flush water larger than the second amount of flush water is discharged. Thereby, even if a malfunction occurs in the control jet unit 20, it does not happen that the flush toilet main body 2 lacks the amount of flush water, and the flush toilet main body 2 can be certainly washed.

Furthermore, according to the flush water tank apparatus 4 of the present embodiment, flush water from the control jet unit 20 causes the first engaging member 46*c* to move to the non-engaging position (FIG. 8A) before the discharge valve 12 descends to the height at which the first engaging member 46*c* and the discharge valve 12 engage with each other. Therefore, the discharge valve 12 disconnected by the clutch mechanism 30 descends to the second float device 28 without engaging with the first float device 26 and is held by the second float device 28 (FIG. 8B). Thereby, it is possible to, when the second amount of flush water is selected, cause the discharge valve 12 to be smoothly and certainly held by the second float device 28.

Further, according to the flush water tank apparatus 4 of the present embodiment, the first engaging member 46*c* is moved to the non-engaging position (FIG. 8A) before the discharge valve 12 is pulled up to the height at which the first engaging member 46*c* of the first float device 26 and the discharge valve 12 engage with each other. Therefore, the discharge valve 12 and the first engaging member 46*c* do not come into contact with each other when the discharge valve 12 is pulled up from the drain port 10*a* by the clutch mechanism 30, and it is possible to cause the discharge valve 12 to be held by the second float device 28 more certainly.

Furthermore, according to the flush water tank apparatus 4 of the present embodiment, the first engaging member 46*c* is kept at the non-engaging position (FIG. 8B) until the discharge valve 12 descends below the height at which the first engaging member 46*c* of the first float device 26 and the discharge valve 12 engage with each other. Therefore, after the clutch mechanism 30 is disconnected, the discharge valve 12 can descend below the first float device 26 without engaging with the first engaging member 46*c*, and it is possible to cause the discharge valve 12 to be held by the second float device 28 smoothly and certainly.

According to the flush water tank apparatus 4 of the present embodiment, since the control jet unit 20, which is a float driving mechanism, drives the first float 26*a* using supplied tap water, it is possible to cause the control jet unit 20 to operate as a float driving mechanism, without separately providing a power source for driving the first float 26*a*.

According to the flush water tank apparatus 4 of the embodiment of the present invention, since the discharge valve 12 and the discharge valve hydraulic drive unit 14 are coupled by the clutch mechanism 30 and disconnected (FIGS. 3A-3H) at a predetermined timing, it becomes possible to cause the discharge valve 12 to move irrespective of the operation speed of the discharge valve hydraulic drive unit 14 and cause the discharge valve 12 to be closed. Further, since, by the control jet unit 20 jetting flush water to the upper surface 26*b* (the water receiving surface) of the first float device 26 (FIG. 8A), the discharge valve 12 is caused to descend early to block the drain port 10*a*, it is possible to set the first or second amount of flush water using the clutch mechanism 30.

According to the flush water tank apparatus 4 of the present embodiment, since the jet port 20*a* of the control jet unit 20 is oriented to face the upper surface 26*b* of the first float device 26 (FIGS. 4A-4B), it is possible to effectively give kinetic energy of water jetted from the jet port 20*a* of the control jet unit 20 to the upper surface 26*b* of the first float 26*a*. Therefore, it is possible to, only by causing a small amount of water to be jetted from the jet port 20*a* of the control jet unit 20, cause the first float device 26 to certainly operate.

Furthermore, according to the flush water tank apparatus 4 of the present embodiment, since the area of the jet port 20*a* of the control jet unit 20 is smaller than the area of the upper surface 26*b* of the first float 26*a*, kinetic energy of water jetted from the jet port 20*a* is received by the upper surface 26*b* without dissipation. Thereby, it is possible to cause the first float device 26 to efficiently operate.

According to the flush water tank apparatus 4 of the present embodiment, since the straight pipe portion 20*b* connected to the jet port 20*a* (FIGS. 4A-4B) is provided, disturbance of flush water jetted from the jet port 20*a* is suppressed. Thereby, directivity of flush water jetted from the control jet unit 20 is improved, and it is possible to cause the first float device 26 to efficiently operate without the jetted flush water easily splashing.

Furthermore, according to the flush water tank apparatus 4 of the present embodiment, since the control jet unit 20 jets flush water downward (FIGS. 4A-4B), the flow velocity of flush water jetted from the jet port 20*a* is increased by the gravity, and greater energy can be given to the upper surface 26*b* of the first float device 26. Thereby, it is possible to cause the first float device 26 to certainly operate.

According to the flush water tank apparatus 4 of the present embodiment, since the upper surface 26*b* of the first float device 26 is submerged in flush water (FIGS. 8A-8B), it is possible to suppress splashing of flush water that is jetted from the control jet unit 20 and hits the upper surface 26*b*.

Furthermore, according to the flush water tank apparatus 4 of the present embodiment, since the jet port 20*a* of the control jet unit 20 is arranged to be submerged, and flush water hits the submerged upper surface 26*b*, it is possible to suppress a sound at the time of flush water being jetted from the jet port 20*a* and a sound at the time of the jetted flush water hitting the upper surface 26*b*.

According to the flush water tank apparatus 4 of the present embodiment, since the wall surface 26*c* (FIGS. 4A-4B) is provided on the upper surface 26*b* of the first float device 26 to surround the collision point P at which flush water hits, it becomes difficult for the flush water hitting the upper surface 26*b* to escape from the upper surface 26*b*, and it is possible to transmit kinetic energy of the flush water to the upper surface 26*b* more effectively.

Furthermore, according to the flush water tank apparatus 4 of the present embodiment, it is possible to switch between engagement (FIG. 5B) and non-engagement (FIG. 8B) between the first holding mechanism 46 and the discharge valve 12 to switch the operation of the first float 26*a*. Thereby, it becomes possible to set a plurality of times during which the discharge valve 12 is open, using a float, and it becomes possible to accurately set the plurality of times during which the discharge valve 12 is open, by a simple mechanism.

According to the flush water tank apparatus 4 of the present embodiment, the second float 28*a* and the second holding mechanism 48 are provided which are configured to hold the discharge valve 12 at a position lower than a position by the first float 26*a* and the first holding mechanism 46. In other words, when the first amount of flush water (large washing) is selected, the discharge valve 12 is held at a predetermined height by the first float 26*a* and the first holding mechanism 46 (FIG. 5B). When the second amount of flush water (small washing) is selected, the discharge valve 12 is held at a lower position by the second float 28*a* and the second holding mechanism 48 (FIG. 8B). Thereby, it is possible to accurately set the first or second amount of flush water using the first float 26*a* or the second float 28*a*.

Furthermore, according to the flush water tank apparatus 4 of the present embodiment, the arm member 46*b* coupled with the first float 26*a* is rotatably supported by the support shaft 46*a*. Further, flush water jetted from the control jet unit 20 hits the water receiving surface formed on the upper surface 26*b* of the first float 26*a*. Since the flush water jetted from the control jet unit 20 collides against the side away from the support shaft 46*a* relative to the center line C of the first float 26*a* (FIG. 4A), it is possible to increase the moment of force around the support shaft 46*a*, which acts by the flush water colliding. Thereby, even when the force of flush water jetted from the control jet unit 20 toward the upper surface 26*b* is relatively weak, the first holding mechanism 46 can be switched to the non-holding state.

The embodiment of the present invention has been described above. Various changes can be added to the embodiment described above.

In the embodiment described above, the first float device 26 and the second float device 28 are provided; and, when the small washing mode is executed, the control jet unit 20 jets flush water toward the first float 26*a* to cause the first engaging member 46*c* of the first float device 26 to be forcedly moved to the non-engaging position. In comparison, as a first modification, a float driving member driven by pressure of supplied flush water, for example, a piston is provided above the first float 26*a*, and a rod is attached to the piston. The present invention can be configured so that the first float 26*a* is pushed down by this rod.

In other words, when the small washing mode is executed, the float driving piston is caused to move, and the first float 26*a* is pushed down via the rod thereby to cause the first engaging member 46*c* to be forcedly moved to the non-engaging position. Thereby, the clutch mechanism 30 is disconnected, and the holding claw 12*b* of the descending discharge valve 12 does not engage with the first engaging member 46*c* of the first float device 26, but the holding claw 12*c* and the second engaging member 48*c* of the second float device 28 engage with each other. When the large washing mode is executed, the float driving piston is not caused to move, and the holding claw 12*b* of the discharge valve 12 is caused to engage with the first engaging member 46*c* of the first float device 26. Thereby, an amount of flush water is set by the second float device 28 when the small washing mode is selected, and an amount of flush water is set by the first float device 26 when the large washing mode is selected. In this modification, the float driving piston and the rod attached thereto function as a float driving mechanism.

As a second modification, a water weight can be used instead of the float driving piston in the first modification. In other words, a small tank that is movable in the vertical direction is arranged in the storage tank 10, and a rod extending downward is provided on the bottom surface of the small tank. Furthermore, the lower end of the rod extending from the small tank is caused to be in contact with the upper surface 26*b* of the first float 26*a*.

When the small washing mode is selected, flush water is caused to flow into the small tank to make a water weight, and the first float 26*a* is forcedly pushed down by the weight of the water weight to cause the first engaging member 46*c* of the first float device 26 to move to the non-engaging position. The clutch mechanism 30 is disconnected thereby, and the holding claw 12*b* of the descending discharge valve 12 does not engage with the first engaging member 46*c* of the first float device 26, but the holding claw 12*c* and the second engaging member 48*c* of the second float device 28 engage with each other. Note that a small hole is provided in a lower part of the small tank so that all flush water in the small tank flows out when a predetermined time has passed. On the other hand, when the large washing mode is executed, flush water is not caused to flow into the small tank, and the holding claw 12*b* of the discharge valve 12 is caused to engage with the first engaging member 46*c* of the first float device 26. Thereby, an amount of flush water is set by the second float device 28 when the small washing mode is selected, and an amount of flush water is set by the first float device 26 when the large washing mode is selected. In this modification, the small tank and the rod attached thereto function as a float driving mechanism.

Furthermore, as a third modification, a small tank and a third float that receives buoyancy therein can be used instead of the float driving piston in the first modification. In other words, the small tank is fixed in the storage tank 10, and the third float that is movable in the vertical direction is arranged in the small tank. Furthermore, a link mechanism is connected to the third float, and the link mechanism is configured so that the first float 26*a* is pushed downward when the third float floats in the small tank.

When the small washing mode is selected, flush water is caused to flow into the small tank to cause the third float to float, and the first float 26*a* is forcedly pushed down via the link mechanism by the buoyancy to cause the first engaging member 46*c* of the first float device 26 to move to the non-engaging position. Thereby, the clutch mechanism 30 is disconnected, and the holding claw 12*b* of the descending discharge valve 12 does not engage with the first engaging member 46*c* of the first float device 26, but the holding claw 12*c* and the second engaging member 48*c* of the second float device 28 engage with each other. Note that a small hole is provided in a lower part of the small tank so that all flush water in the small tank flows out when a predetermined time has passed, and the third float descends. On the other hand, when the large washing mode is executed, flush water is not caused to flow into the small tank, and the holding claw 12*b* of the discharge valve 12 is caused to engage with the first engaging member 46*c* of the first float device 26. Thereby, an amount of flush water is set by the second float device 28 when the small washing mode is selected, and an amount of flush water is set by the first float device 26 when the large washing mode is selected. In this modification, the small tank, the third float and the link mechanism connected to the third float function as a float driving mechanism.

In the embodiment described above, the first float device 26 and the second float device 28 are provided; and, when the small washing mode is executed, the control jet unit 20 jets flush water toward the first float 26*a* to cause the first float 26*a* to be forcedly switched to the non-holding state. In comparison, as a fourth modification, the present invention can be configured so that the control jet unit 20 jets flush water toward the clutch mechanism 30 to release the clutch mechanism 30. In other words, when the small washing mode is executed, by jetting flush water from the control jet unit 20 toward the clutch mechanism 30 at a timing when the holding claw 12*b* of the discharge valve 12 is pulled up to a height between the height of the first engaging member 46*c* of the first float device 26 and the height of the second engaging member 48*c* of the second float device 28, the clutch mechanism 30 is released. A configuration is made in which, when the large washing mode is executed, the clutch mechanism 30 is released at a timing when the holding claw 12*b* of the discharge valve 12 is pulled up above the first engaging member 46*c* of the first float device 26. Thereby, when the small washing mode is selected, the timing of the drain port 10*a* being blocked can be earlier than the case of the large washing mode being selected. In this modification, the clutch mechanism 30 also functions as a timing control mechanism, and a surface of the clutch mechanism 30 that receives jet of flush water from the control jet unit 20 functions as a water receiving surface.

As a fifth modification, the present invention can be configured so that only one float device is provided as a timing control mechanism. In other words, the flush water tank apparatus 4 is configured so that the discharge valve 12 is held by one float device no matter which of the large washing mode and the small washing mode is selected. Then, by jetting flush water from the control jet unit 20 toward a float at a predetermined timing, the float device is switched to the non-holding state. Furthermore, by, when the small washing mode is selected, jetting flush water from the control jet unit 20 earlier than the case of the large washing mode being selected, the timing of the drain port 10*a* being blocked when the small washing mode is selected can be earlier. In this modification, the single float device functions as a timing control mechanism, and a surface of the float device that receives jet of flush water from the control jet unit 20 functions as a water receiving surface.

Or alternatively, as a fifth modification, a configuration can be made in which a single float device is energized to be in the non-holding state, using a spring mechanism or the like. Then, by jetting flush water from the control jet unit 20 to the spring mechanism, the float device is forcedly switched to the holding state against the energizing force of the spring mechanism. In this modification, by stopping jet of flush water from the control jet unit 20, the float device can be switched to the non-holding state. Therefore, by, when the small washing mode is selected, stopping jet of flush water from the control jet unit 20 earlier than the case of the large washing mode being selected, the timing of the drain port 10*a* being blocked can be earlier when the small washing mode is selected. In this modification, the spring mechanism functions as a timing control mechanism, and a surface of the spring mechanism that receives jet of flush water from the control jet unit 20 functions as a water receiving surface.

Furthermore, as a sixth modification, the present invention can be configured so that the clutch mechanism 30 is released at a predetermined timing by jet of flush water from the control jet unit 20, without using a float mechanism. The control jet unit 20 is arranged to jet flush water toward the clutch mechanism 30. Furthermore, the clutch mechanism 30 is configured so that it is not released even when the discharge valve 12 is pulled up to the upper end but is released when flush water from the control jet unit 20 hits. In this configuration, by, when the small washing mode is selected, jetting flush water from the control jet unit 20 earlier than the case of the large washing mode being selected, the timing of the drain port 10*a* being blocked when the small washing mode is selected can be earlier. In this modification, the clutch mechanism 30 also functions as a timing control mechanism, and a surface of the clutch mechanism 30 that receives jet of flush water from the control jet unit 20 functions as a water receiving surface.

Or alternatively, as a sixth modification, a spring mechanism or the like configured to cause the clutch mechanism 30 to be forcedly released is provided, and the spring mechanism is configured not to be able to release the clutch mechanism 30 when flush water from the control jet unit 20 hits. In this modification, by stopping jet of flush water from the control jet unit 20, the spring mechanism can be switched to a state of being able to release the clutch mechanism 30. Therefore, by, when the small washing mode is selected, stopping jet of flush water from the control jet unit 20 earlier than the case of the large washing mode being selected, the timing of the drain port 10*a* being blocked can be earlier when the small washing mode is selected. In this modification, the spring mechanism functions as a timing control mechanism, and a surface of the spring mechanism that receives jet of flush water from the control jet unit 20 functions as a water receiving surface.

REFERENCE SIGNS LIST

1 flush toilet apparatus
2 flush toilet main body (flush toilet)
2*a* bowl
4 flush water tank apparatus
6 remote controller (flush water amount selection device)
6*a* push button
8 human sensor
10 storage tank
10*a* drain port
10*b* overflow pipe
12 discharge valve
12*a* valve stem
12*b* holding claw
12*c* holding claw
14 discharge valve hydraulic drive unit
14*a* cylinder
14*b* piston
14*c* spring
14*d* gap
14*e* packing
14*f* through hole
16 water supply control valve
16*a* main valve body
16*b* main valve port
16*c* pressure chamber
16*d* pilot valve
16*e* pilot valve
18 solenoid valve
20 control jet unit (float driving mechanism)
20*a* jet port
20*b* straight pipe portion
22 flush water amount control valve
22*a* main valve body
22*b* pressure chamber
22*c* pilot valve
24 solenoid valve
26 first float device (timing control mechanism)
26*a* first float
26*b* upper surface (water receiving surface)
28 second float device
28*a* second float
28*a* second float
30 clutch mechanism
30*a* rotary shaft
30*b* hook member
30*c* engaging claw
32 rod
34*a* drive unit water supply passage
34*b* drive unit discharge passage
34*c* discharge passage branch portion
36 vacuum breaker
38 water supply pipe
38*a* stop cock
40 controller (flush water amount selection device)

42 float switch
44 vacuum breaker
46 first holding mechanism
46*a* support shaft
46*b* arm member
46*c* first engaging member
48 second holding mechanism
48*a* support shaft
48*b* arm member
48*c* second engaging member

What is claimed is:

1. A flush water tank apparatus for supplying flush water to a flush toilet, the flush water tank apparatus comprising:

a storage tank storing flush water to be supplied to the flush toilet, with a drain port for discharging the stored flush water to the flush toilet formed therein;

a discharge valve opening/closing the drain port and performing supply/stop of the flush water to the flush toilet;

a discharge valve hydraulic drive unit driving the discharge valve using water supply pressure of supplied tap water;

a clutch mechanism coupling the discharge valve and the discharge valve hydraulic drive unit to pull up the discharge valve by driving force of the discharge valve hydraulic drive unit, and being disconnected at a predetermined timing to cause the discharge valve to descend;

a flush water amount selection device capable of selecting between a first amount of flush water for washing the flush toilet and a second amount of flush water smaller than the first amount of flush water;

a first float device comprising a first float moved according to a water level in the storage tank and a first engaging member capable of moving to an engaging position of engaging with the discharge valve to hold the discharge valve and a non-engaging position of not engaging with the discharge valve in conjunction with movement of the first float;

a second float device comprising a second float moved according to the water level in the storage tank and a second engaging member capable of moving to an engaging position of engaging with the discharge valve and a non-discharging position of not engaging with the discharge valve in conjunction with movement of the second float and causing the second engaging member to move to the non-engaging position at a height different from a height at which the first float causes the first engaging member to move to the non-engaging position; and a float driving mechanism driving the first float to cause the first engaging member to move to the non-engaging position when the second amount of flush water is selected by the flush water amount selection device;

wherein by the first engaging member of the first float device being moved to the non-engaging position, the discharge valve engages with the second engaging member of the second float device.

2. The flush water tank apparatus according to claim 1, wherein the first float device is configured to hold the discharge valve at a position higher than a position at which the second float device holds the discharge valve, and the float driving mechanism is configured to drive the first float to cause the first engaging member to move to the non-engaging position before the second engaging member is moved to the non-engaging position in conjunction with the second float.

3. The flush water tank apparatus according to claim 2, wherein the clutch mechanism is configured to be disconnected at a position higher than a height at which the first engaging member of the first float device and the discharge valve engage with each other, and the float driving mechanism is configured to drive the first float to cause the first engaging member to move to the non-engaging position before the discharge valve descends to the height at which the first engaging member and the discharge valve engage with each other.

4. The flush water tank apparatus according to claim 3, wherein the clutch mechanism is configured to pull up the discharge valve from the drain port, and the float driving mechanism is configured to drive the first float to cause the first engaging member to move to the non-engaging position before the discharge valve is pulled up to the height at which the first engaging member of the first float device and the discharge valve engage with each other.

5. The flush water tank apparatus according to claim 4, wherein the float driving mechanism is configured to, after the clutch mechanism is disconnected, keep the first engaging member at the non-engaging position until the discharge valve descends below the height at which the first engaging member of the first float device and the discharge valve engage with each other.

6. The flush water tank apparatus according to claim 1, wherein the float driving mechanism is configured to drive the first float using the supplied tap water.

7. The flush water tank apparatus according to claim 1, wherein the float driving mechanism comprises a control jet unit jetting, when the second amount of flush water is selected by the flush water amount selection device, flush water from a jet port to a water receiving surface provided on the first float device so that a timing of the drain port being blocked is earlier than a case of the first amount of flush water being selected.

8. The flush water tank apparatus according to claim 7, wherein the jet port of the control jet unit is provided being oriented to face the water receiving surface of the first float device.

9. The flush water tank apparatus according to claim 8, wherein the jet port of the control jet unit is formed with an area smaller than an area of the water receiving surface of the first float device.

10. The flush water tank apparatus according to claim 7, wherein the control jet unit is provided with a straight pipe portion connected to the jet port, and turbulence of flush water jetted through the jet port is suppressed by the straight pipe portion.

11. The flush water tank apparatus according to claim 7, wherein the jet port of the control jet unit is arranged to jet flush water downward.

12. The flush water tank apparatus according to claim 7, wherein the water receiving surface of the first float device is arranged to be submerged in flush water stored in the storage tank, and the control jet unit jets flush water to the submerged water receiving surface.

13. The flush water tank apparatus according to claim 7, wherein the jet port of the control jet unit is arranged to be submerged in flush water stored in the storage tank and jets flush water to the submerged water receiving surface of the first float device.

14. The flush water tank apparatus according to claim 7, wherein the water receiving surface of the first float device is provided with a wall surface surrounding a collision point at which flush water jetted from the control jet unit hits.

15. The flush water tank apparatus according to claim 7, wherein the first float device comprises a first holding mechanism switchable between a holding state and a non-holding state in conjunction with the movement of the first float;

the first holding mechanism comprises an arm member rotatably supported by a support shaft, one end of the arm member being coupled with the first float; and the control jet unit jets flush water toward the water receiving surface formed on an upper surface of the first float, and the jetted flush water collides against a side away from the support shaft relative to a center line of the first float in a plan view.

16. A flush toilet apparatus comprising a plurality of washing modes with different amounts of flush water, the flush toilet apparatus comprising:

a flush toilet; and the flush water tank apparatus according to claim 1 supplying flush water to the flush toilet.

* * * * *